US009995113B2

(12) United States Patent
Garcia et al.

(10) Patent No.: US 9,995,113 B2
(45) Date of Patent: Jun. 12, 2018

(54) METHOD AND APPARATUS FOR TREATING A WELLBORE

(71) Applicant: Weatherford Technology Holdings, LLC, Houston, TX (US)

(72) Inventors: Cesar G. Garcia, Katy, TX (US); David Ward, Houston, TX (US); Michael Sessa, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 621 days.

(21) Appl. No.: 14/555,055

(22) Filed: Nov. 26, 2014

(65) Prior Publication Data

US 2015/0152713 A1 Jun. 4, 2015

Related U.S. Application Data

(60) Provisional application No. 61/909,566, filed on Nov. 27, 2013, provisional application No. 62/010,554, filed on Jun. 11, 2014, provisional application No. 62/010,559, filed on Jun. 11, 2014, provisional application No. 62/010,563, filed on Jun. 11, 2014.

(51) Int. Cl.

| | |
|---|---|
| ***E21B 34/14*** | (2006.01) |
| ***E21B 23/01*** | (2006.01) |
| ***E21B 43/26*** | (2006.01) |
| ***E21B 33/124*** | (2006.01) |
| ***E21B 47/12*** | (2012.01) |
| ***E21B 33/12*** | (2006.01) |
| *E21B 34/00* | (2006.01) |

(52) U.S. Cl.
CPC ..... *E21B 34/14* (2013.01); *E21B 23/01* (2013.01); *E21B 33/124* (2013.01); *E21B 33/1208* (2013.01); *E21B 43/26* (2013.01); *E21B 47/122* (2013.01); *E21B 2034/007* (2013.01)

(58) Field of Classification Search
None
See application file for complete search history.

(56) References Cited

U.S. PATENT DOCUMENTS

| | | | | |
|---|---|---|---|---|
| 5,309,988 | A * | 5/1994 | Shy | E21B 34/14 166/237 |
| 5,413,173 | A | 5/1995 | Mills et al. | |
| 5,549,161 | A | 8/1996 | Gomez et al. | |
| 7,387,165 | B2 | 6/2008 | Lopez de Cardenas et al. | |
| 2007/0272411 | A1 | 11/2007 | Lopez de Cardenas et al. | |
| 2009/0071655 | A1 * | 3/2009 | Fay | E21B 34/14 166/332.1 |
| 2009/0139726 | A1 | 6/2009 | Gomez | |

(Continued)

OTHER PUBLICATIONS

Canadian Office Action dated Sep. 15, 2016, for Canadian Patent Application No. 2,913,408.

(Continued)

*Primary Examiner* — Caroline N Butcher
(74) *Attorney, Agent, or Firm* — Patterson & Sheridan, L.L.P.

(57) ABSTRACT

A method and apparatus generally concerning the treatment of hydrocarbon-bearing formations adjacent a wellbore. In one embodiment, fracturing jobs are performed through the use of subs disposed in a casing string having profiles that interact with profiles formed on retractable keys of a tool.

16 Claims, 28 Drawing Sheets

(56) References Cited

U.S. PATENT DOCUMENTS

| | | | | |
|---|---|---|---|---|
| 2010/0108323 | A1 | 5/2010 | Wilkin | |
| 2014/0352981 | A1* | 12/2014 | Fripp | E21B 41/0085 166/381 |

OTHER PUBLICATIONS

PCT International Search Report and Written Opinion dated Jan. 26, 2016, for International Application No. PCT/US2014/067675.
Canadian Office Action dated May 31, 2017, for Canadian Patent Application No. 2,913,408.

* cited by examiner

METHOD AND APPARATUS FOR TREATING A WELLBORE

BACKGROUND OF THE INVENTION

Field of the Invention

Embodiments of the present invention generally relate to a method and apparatus for use in a wellbore. More particularly, the invention relates to treating a zone of interest in a wellbore.

Description of the Related Art

With extended reach wells, it is common to have multiple hydrocarbon-bearing zones at different locations along the length of a wellbore. In order to increase production at the various zones, they are often "fractured." Fracturing is a technique in which a liquid, like water is mixed with sand and chemicals and injected at high pressure into a hydrocarbon-bearing formation (zone) surrounding the wellbore. The resulting small fractures (typically less than 1 mm) permit oil and gas to migrate to the wellbore for collection. Multiple zones at different depths mean multiple fracturing jobs requiring each zone to be isolated from adjacent zones, typically through the use of packers that seal an annular area between the wellbore and a tubular string extending back to the surface of the well.

In some instances, the zones are fractured in separate trips using bridge plugs, resulting in multiple trips and increased costs. In other cases, the zones are treated using ball seats and balls of various sizes, resulting in wellbore debris when the balls are "blown out" to reach a lower zone. What is needed is a more efficient apparatus and methods for treating multiple zones in a single trip.

SUMMARY OF THE INVENTION

The present invention generally concerns the treatment of hydrocarbon-bearing formations adjacent a wellbore. In one embodiment, fracturing jobs are performed through the use of subs disposed in a casing string having profiles that interact with profiles formed on retractable keys of a tool.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention relates to treating a wellbore. More specifically, the invention relates to treating multiple areas adjacent a wellbore in a single trip.

Figure 1:
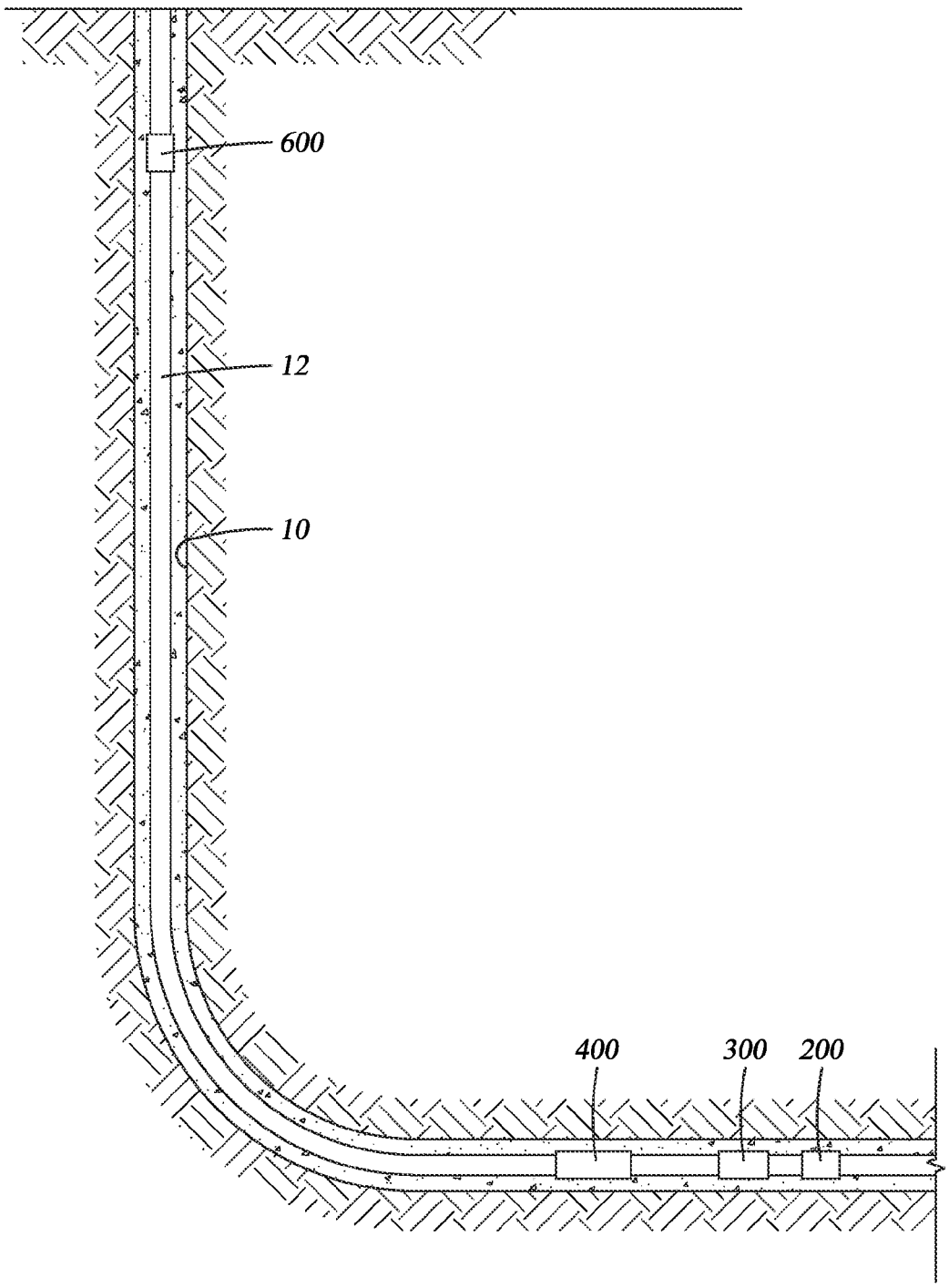
FIG. 1 is a section view of a wellbore with a casing string cemented therein and including a locator sub, anchor sub, port sub and test sub.

FIG. 1 is a section view of a wellbore 10 with a casing string 12 cemented therein. The string includes three subs at a lower end thereof. A locator sub 200 at a lower end of the string is used to locate and temporarily retain the drag blocks of a fracturing tool 100 (FIG. 4) as will be described. An anchor sub 300 located above the locator sub primarily serves to anchor the fracturing tool 100 and prevent downward motion while high pressure fracturing fluid is being pumped from the surface of the well. Above the anchor sub is a port sub 400 with fracturing ports (not shown) that are opened to permit a fluid path between the wellbore and a zone therearound to be treated. While the component shown and described is referred to as a port sub, in fact it can be any downhole component capable of selectively creating a fluid path from the interior to the exterior of the component. At a location higher still in the wellbore is a test sub 600, the operation of which will be explained herein. The subs 200, 300, 400 primarily operate through the use of inward-facing profiles that are constructed and arranged to selectively interact with mating profiles formed on keys of the fracturing tool 100. For example, the locator sub 200 includes a profile formed in its interior, which has an angled surface at an upper and lower end. Above the locator sub 200, an anchor sub 300 is equipped with an inwardly facing anchor profile which includes an upward facing square shoulder to prevent downward motion of the tool when a key of the tool is interacting with the profile. In this disclosure, keys, ports and profiles are typically referred to in the singular as the Figures often show only one. It will be understood that in every instance there is at least one of each and typically multiples. For example, in one embodiment of the invention there are four keys equally disposed around the body of the tool 100 and those keys interact with four mating profiles formed in each sub 200, 300, 400.

Thereabove, the port sub 400, like the anchor sub 300 includes two upward facing square shoulders but also includes an angled surface that disengages the keys from the anchor profile after the tool has moved down far enough to uncover fracturing ports. The subs 200, 300, 400 are located relative to one another in the string 12 in order to manipulate or to be manipulated by the fracturing tool 100. In one aspect, the fracturing tool is first located in the locator sub 200 where spring-biased keys on the tool are exposed. In this manner the tool 100 is shifted from a non-operable to an operable mode. Thereafter, the tool 100 is raised past the anchor sub 300 to the port sub 400 where the exposed keys are used to uncover fracturing ports leading to the wellbore around the tool. Once the ports are open, the tool 100 is lowered and landed in the anchor sub 300. At least one sealing member, in this case cup seals 140 between the anchor sub and the fracturing ports are used to seal an annular area between the tool 100 and the wellbore 10 as high pressure fracturing fluid is introduced into the annulus between the wellbore and coiled tubing string upon which the fracturing tool is run into the wellbore 10. Once the fracturing job is completed, the tool 100 can be removed from the well. Alternatively, the tool 100 can be raised to a set of subs at a higher location in the wellbore and another fracturing job can take place. In one embodiment, the keys are retracted through the use of another sub (like the locator sub 200) and the tool can be run to a set of subs at some lower area in the wellbore.

While the present invention is described with embodiments relating to fracturing and the pumping of fracturing fluid, the components and tools herein can be used to pass a variety of material from an interior to an exterior of a casing string.

Figure 2:
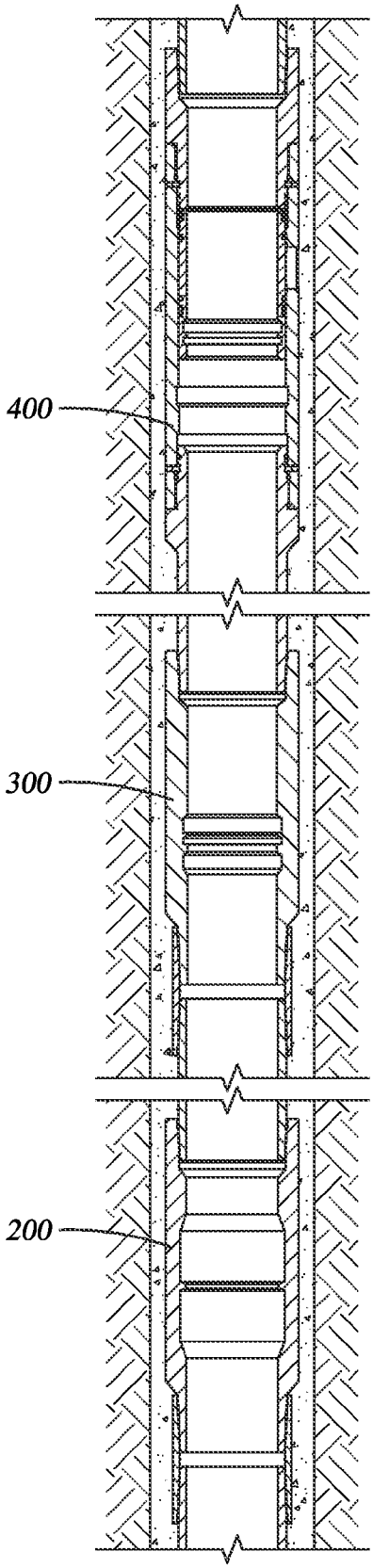
FIG. 2 is an enlarged view of the wellbore showing interior detail of the three subs of FIG. 1.
Figure 3:
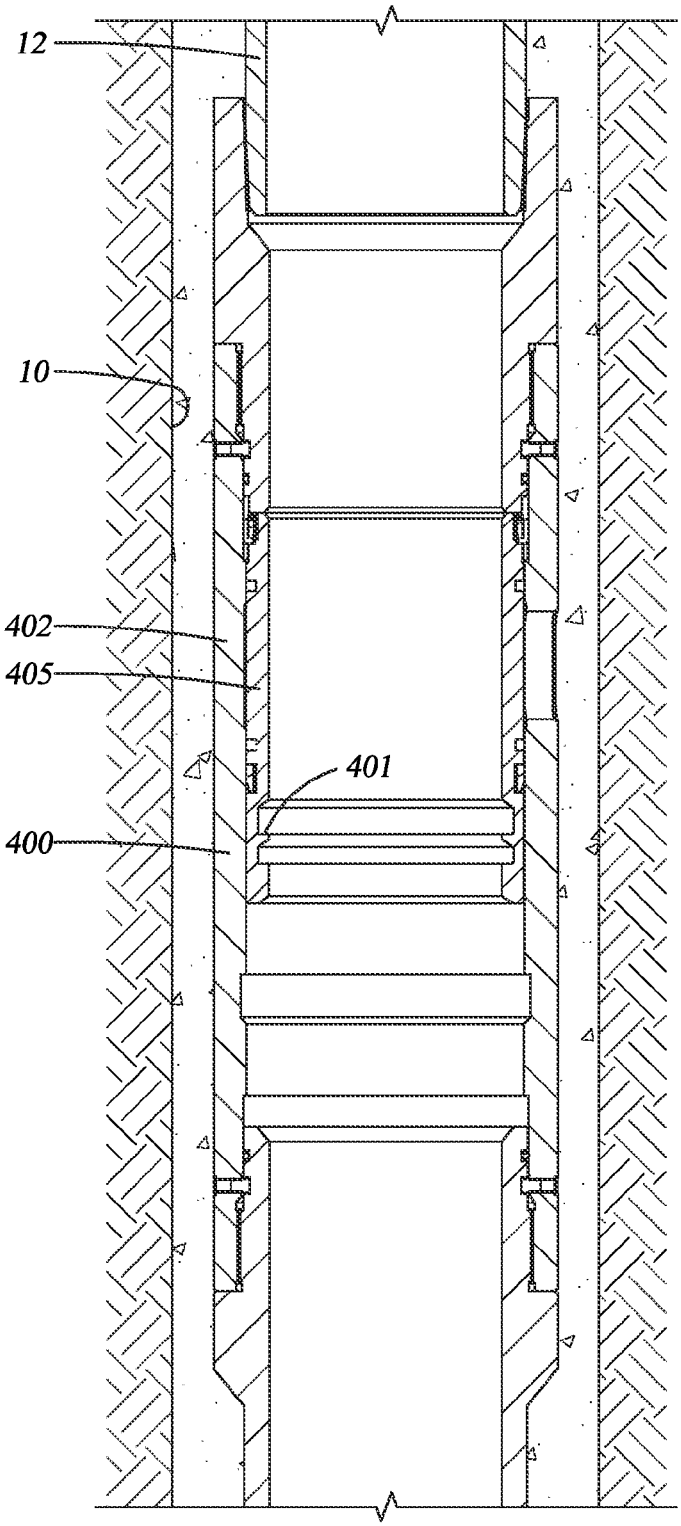
FIG. 3 is a detailed view of a port sub.

FIG. 2 is an enlarged view of the wellbore 10 showing some interior detail of the three subs 200, 300, 400 of FIG. 1 and FIG. 3 is a more detailed view of a port sub 400. While the locator 200 and anchor 300 subs are shown as separate components in the Figures, it will be understood that they could be combined into a single sub having the profiles/ports described.

Figure 4:
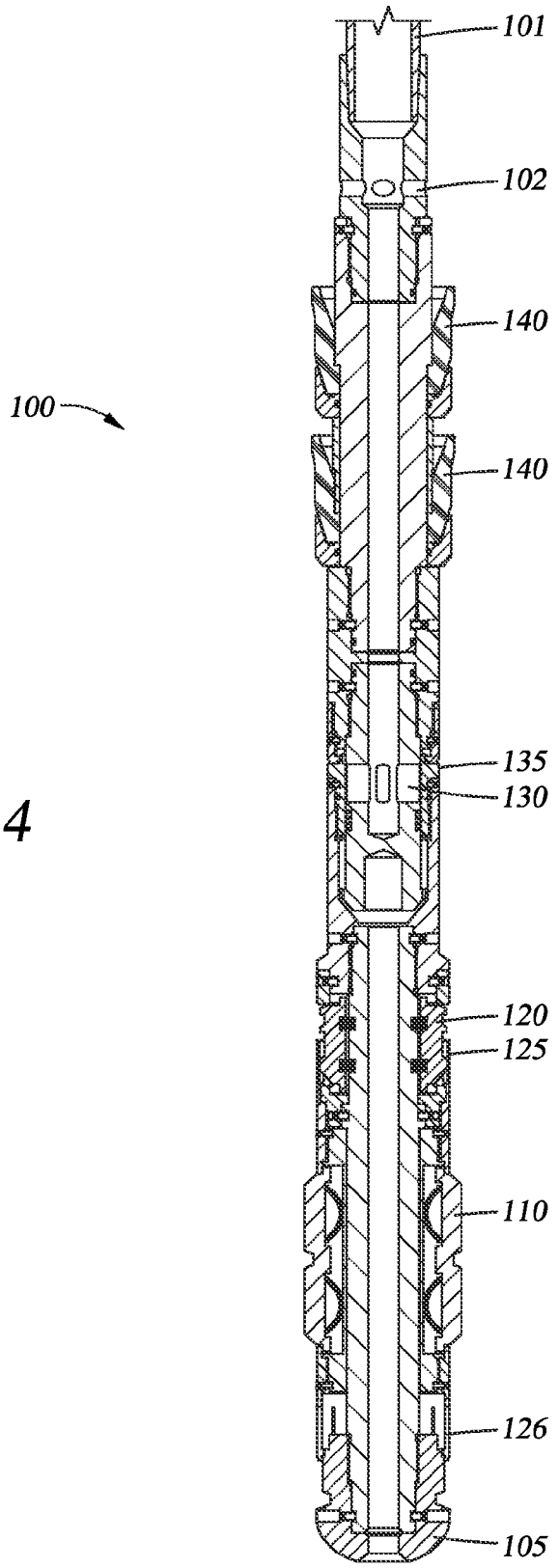
FIG. 4 is a section view of a fracturing tool.

FIG. 4 is a section view of a fracturing tool 100. The tool is typically run into the well at the end of a string of coiled tubing 101. The tool includes a nose portion 105, a set of outwardly-biased drag blocks 110, a set of outwardly-biased keys 120 with a collet actuated retaining sleeve 125 that acts to keep the keys recessed, and a telescoping feature that permits a fluid path to be formed between through the tool as it is moved upwards in the fluid-filled wellbore 10. In the embodiment of FIG. 4, the fluid path in the tool 100 extends from a set of lower ports 130 to a set of higher ports 102. In FIG. 4, the fluid path is closed due to the location of a sleeve 135 over lower ports 130. At an upper end of the tool 100 are two cup seals 140 constructed and arranged to facilitate the movement of the tool downhole by pumping and to seal an annular area (not shown) between the tool 100 and the wellbore 10 while a zone above the cup seals 140 is fractured. In the embodiment of FIG. 4, the tool 100 is run into the well on a string of coiled tubing 101 and upper ports 102 serve to permit pressure communication between an interior of the coiled tubing 101 and the wellbore to avoid collapse of the tubing as the tool 100 is run into the wellbore.

Figure 5:
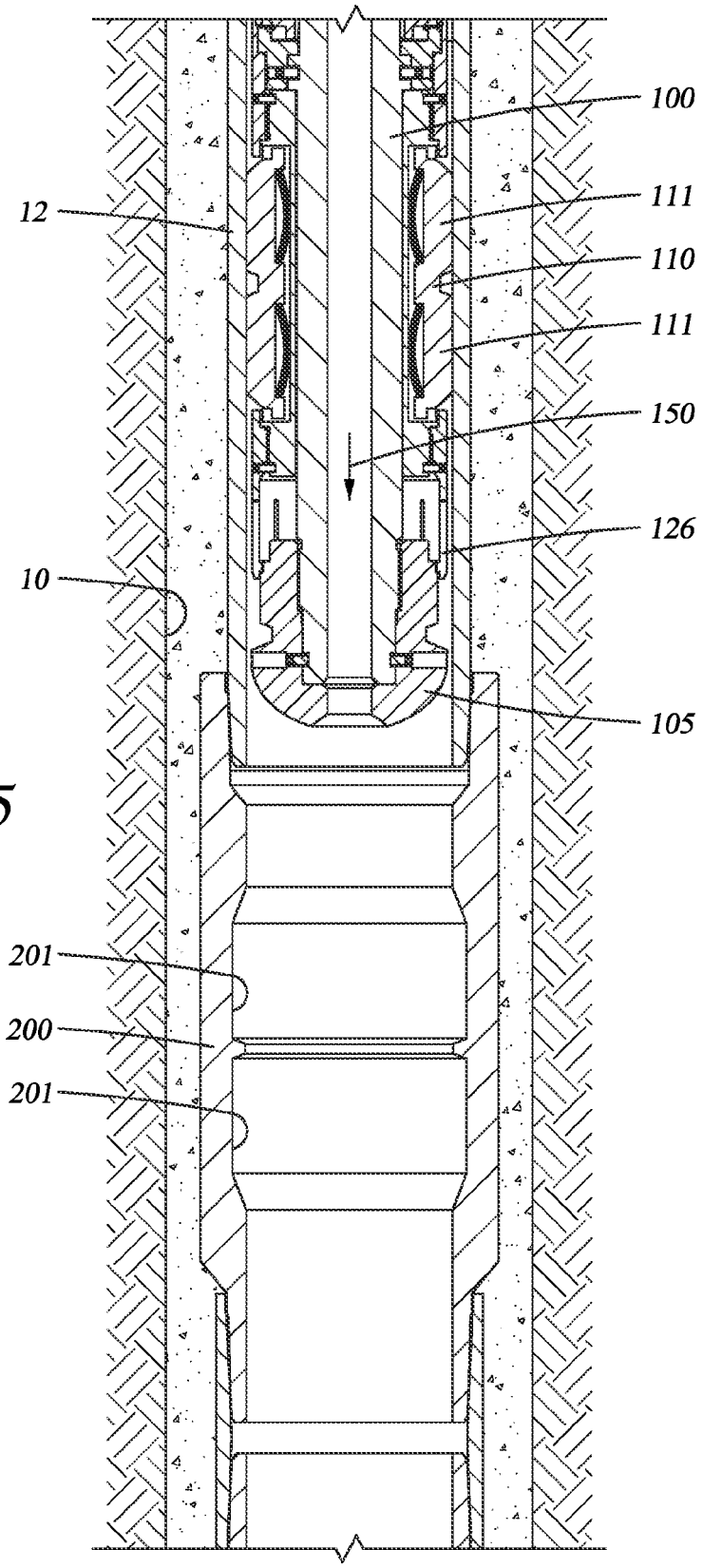
FIG. 5 is a section view of the fracturing tool moving downhole into engagement with the locator sub.
Figure 6:
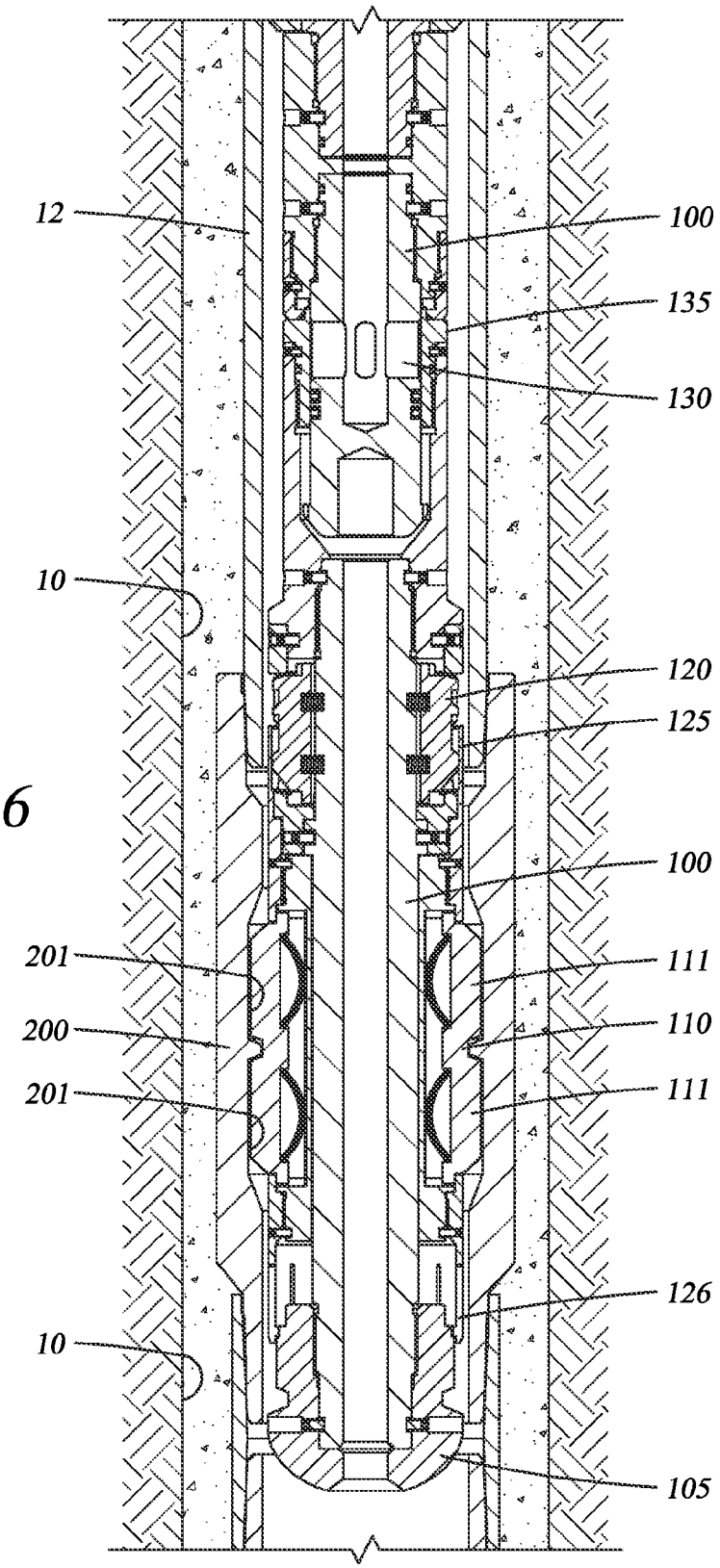
FIG. 6 is a section view of the wellbore with the drag blocks of the tool engaged with mating profiles formed in the interior of the locator sub.

The function and use of the assembly will be described based upon the Figures showing the tool 100 in various positions relative to the subs 200, 300, 400. FIG. 5 is a section view of the fracturing tool 100 moving downhole (arrow 150) into engagement with the locator sub 200. As shown, the drag blocks 110 have two outwardly facing profiles 111, each of which have a sloped formation at the top and bottom. The blocks are designed to mate with corresponding inwardly formed profiles 201 in the locator sub 200. FIG. 6 is a section view of the wellbore 10 with the drag blocks 110 engaged with the mating profiles 201 formed in the interior of the locator sub 200. Visible in the Figure are the keys 120 which are recessed due to the retaining sleeve 125 that extends over their outer surface. The sleeve 125 is retained its initial position with collet fingers 126 that are housed in an upper profile formed on the nose portion 105 of the tool, as shown. Also visible in FIG. 6 the fluid path through the fracturing tool remains closed with lower ports 130 blocked by sleeve 135.

Figure 7:
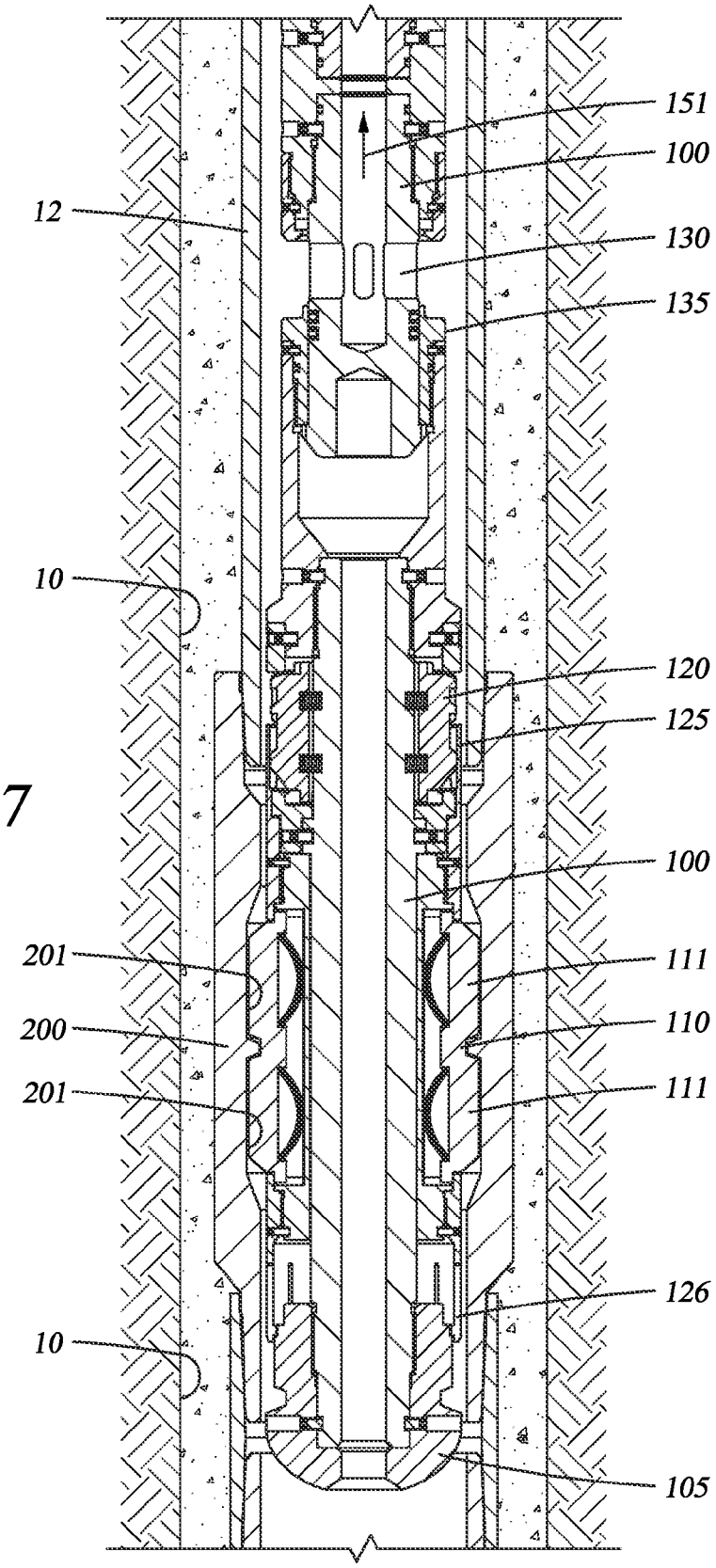
FIG. 7 is a section view of the wellbore illustrating a fluid path that has been opened through the fracturing tool due to telescopic movement of the tool.
Figure 8:
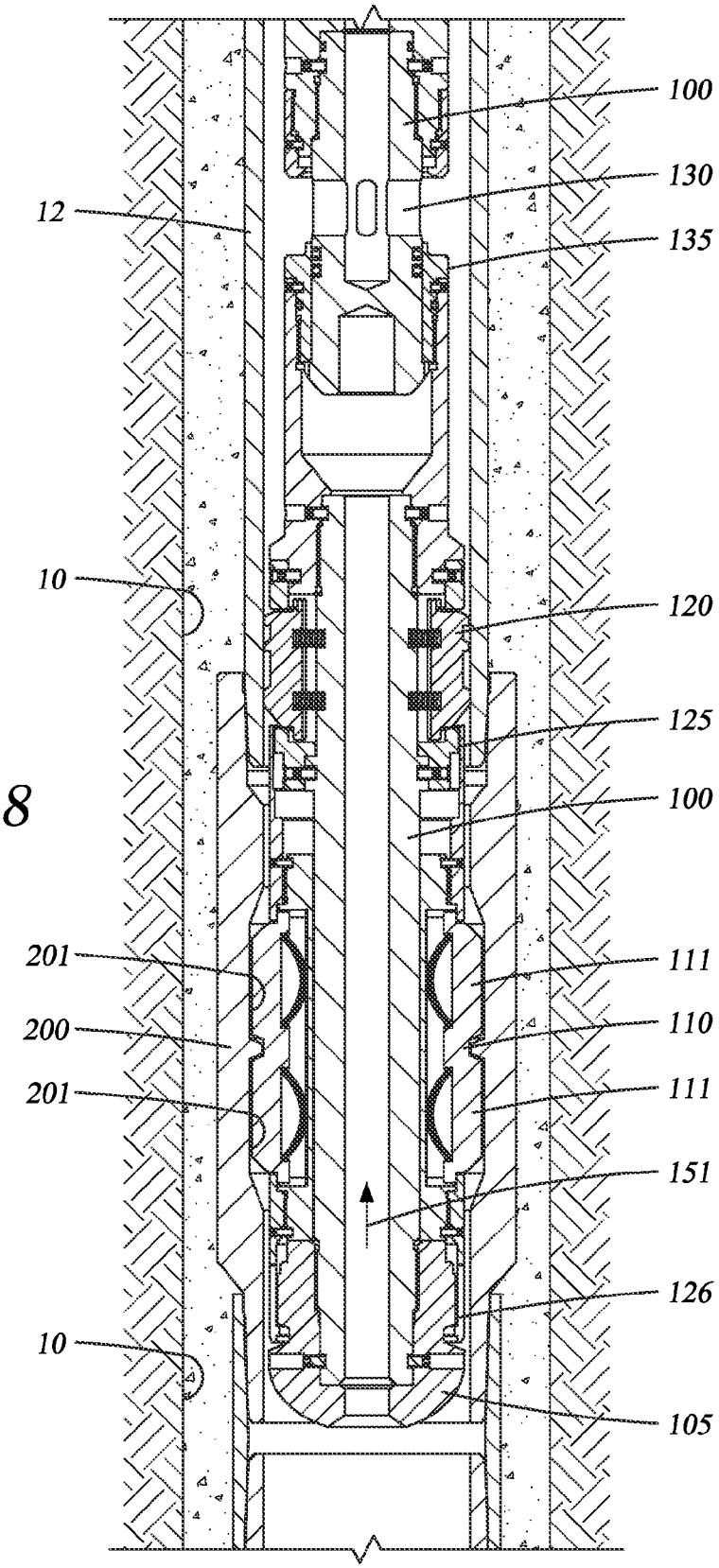
FIG. 8 is a section view of the wellbore showing keys of the fracturing tool exposed due to upward movement of an interior portion of the tool relative to the keys.

FIG. 7 is a section view of the wellbore. Lower ports 130 of the tool 100 have been opened due to a telescopic feature of the tool whereby upward movement, typically from the surface (arrow 151) causes the tool to lengthen and the ports 130 to move axially relative to the sleeve 135. FIG. 8 is a section view of the wellbore 10 showing keys 120 of the fracturing tool exposed due to additional upward movement of the interior portion of the tool 100. As illustrated, the collet fingers 126 have moved from the upper profile in nose portion to a lower profile and the retaining sleeve 125 has moved to a location below the spring-biased keys 120 and permitted them to extend outwards and into contact with the surrounding casing 12. In this position, with the fluid path through the tool open and the keys extended, the tool 100 can be moved upwards in the wellbore and interact with subs 300, 400 thereabove, depending upon the design of the profiles formed in the subs.

Figure 9:
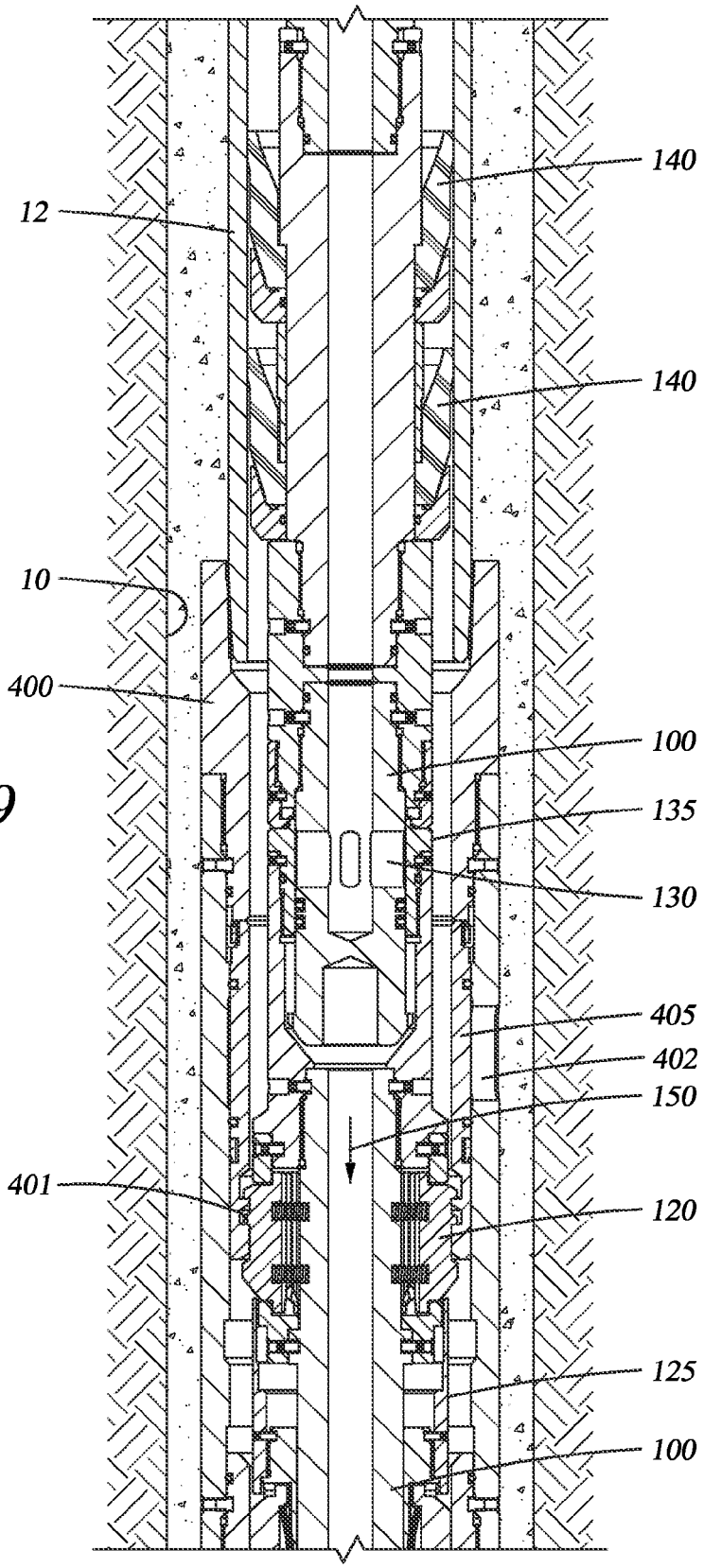
FIG. 9 is a section view showing the fracturing tool being urged downwards with its keys landed in internal profiles of the port sub.

FIG. 9 is a section view showing the fracturing tool 100 being urged downward with its keys 120 landed in internal profiles of the port sub 400. As shown, the keys 120, with their downward facing square shoulders have engaged correspondingly square upward facing shoulders of the port sub 400. In order to attain this position, the tool was raised in the wellbore out of the locator sub 200 (overcoming resistance of the drag block profiles 110 within the profiles 201 of the locator sub) and past the anchor 300 and port 400 subs (there is no interference between the keys 120 of the tool 100 and these two subs as the tool moves upwards). Thereafter, the tool 100 is lowered into contact with the port sub 400 and as shown, the keys 120 engage the inwardly facing profiles 401 of the port sub. Downward movement of the tool 100 into contact with the port sub 400 can be accomplished by pushing the coiled tubing string 101 from the surface. However, in one embodiment, the tool is "pumped" downwards by the action of pressurized fluid on the cup seals 140 of the tool 100. This is possible in part because the fluid path through the tool between upper 102 and lower 130 ports that permits fluid to pass through the tool in the area of the cup seals is closed due to the action of the pressurized fluid on the cup seals. In operation, the pumped fluid initially de-telescopes the tool (thereby covering the lower ports) before it moves downwards and into contact with the port sub 400.

Figure 10:
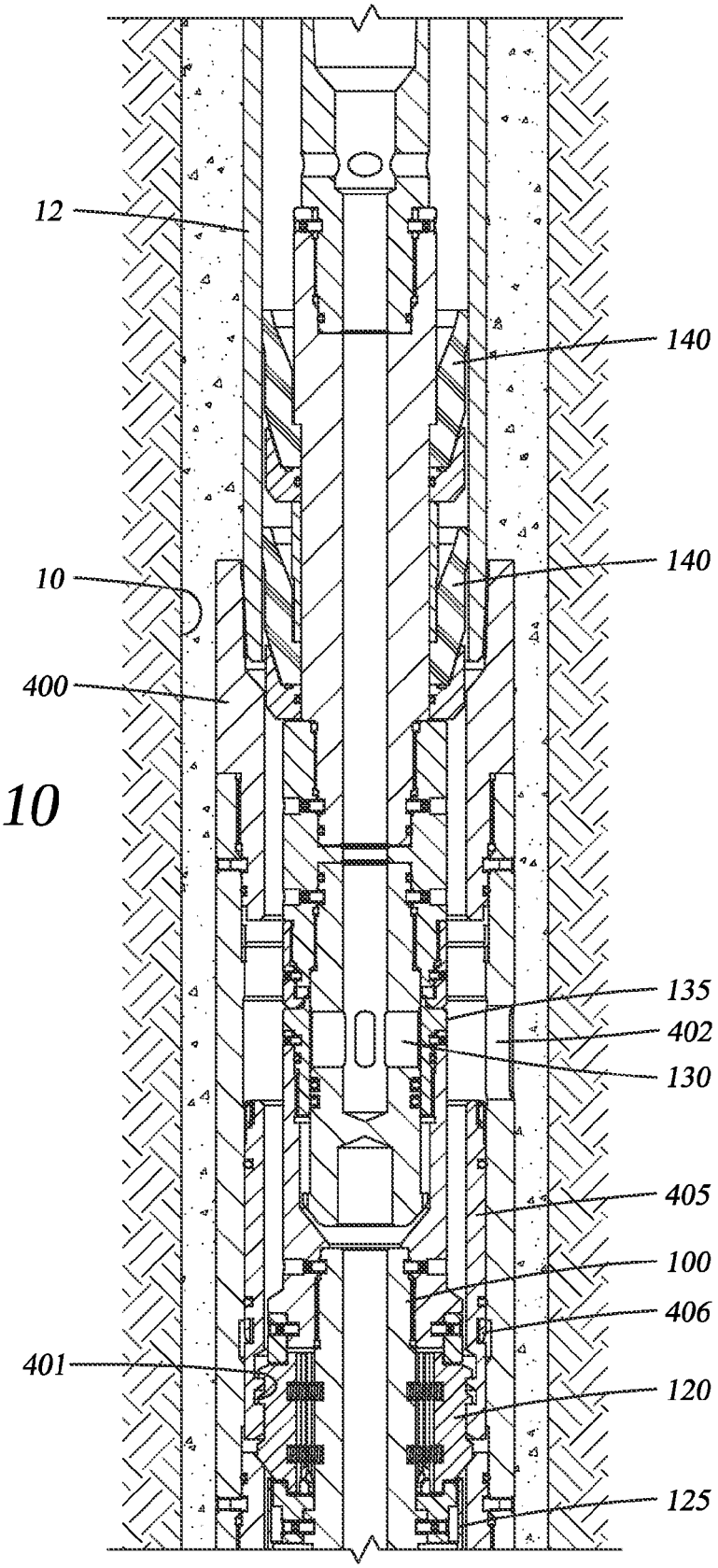
FIG. 10 illustrates the fracturing tool in the port sub after downward movement of the tool has exposed fracturing ports in the sub.

FIG. 10 illustrates the fracturing tool 100 in the port sub 400 after downward movement of the tool has exposed fracturing ports 402 in the sub 400. The port sub is constructed in a manner whereby downward motion on the inwardly facing profiles 401 moves a port sleeve 405 downwards, exposing the plurality of the ports 402 leading from an interior of the sub 400 to a cement-filled annulus between the sub 400 and the wellbore 10. In the embodiment of FIG. 10, the sleeve 405 is locked in an open position due to a snap ring 406 and a mating profile in an outer surface of the sleeve. The casing string 12 is assembled whereby the port sub 400 will become part of the wellbore at a location adjacent a formation to be fractured. Also visible in FIG. 10 is an inwardly facing release profile 401 adjacent the keys 120. The release profile 401 is constructed to contact the keys 120 and urge the biased keys inward enough to permit the tool to be pumped downward in the direction of the anchor sub 300.

Figure 11A:
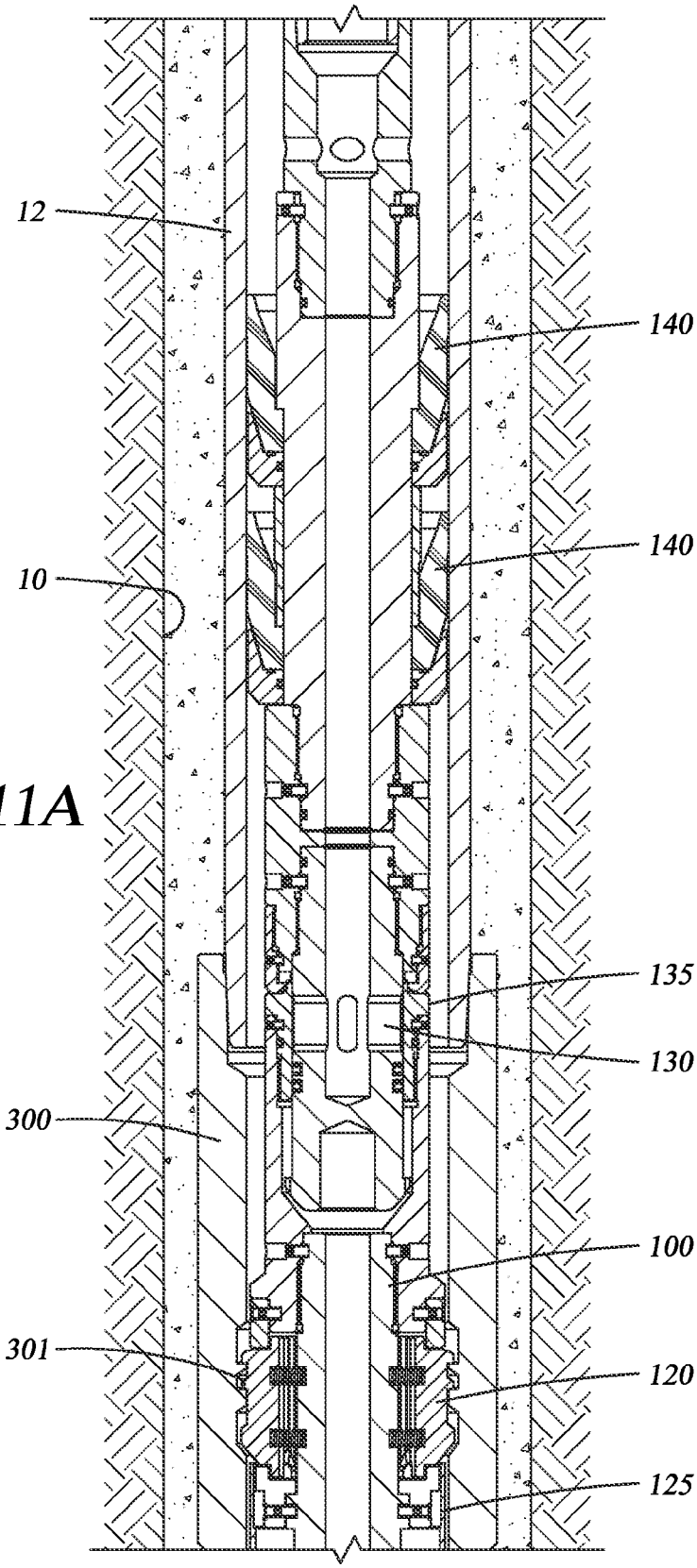
FIGS. 11A and 11B are a section view of the wellbore with the keys of the tool located in the anchor sub and a fracturing job in progress.
Figure 11B:
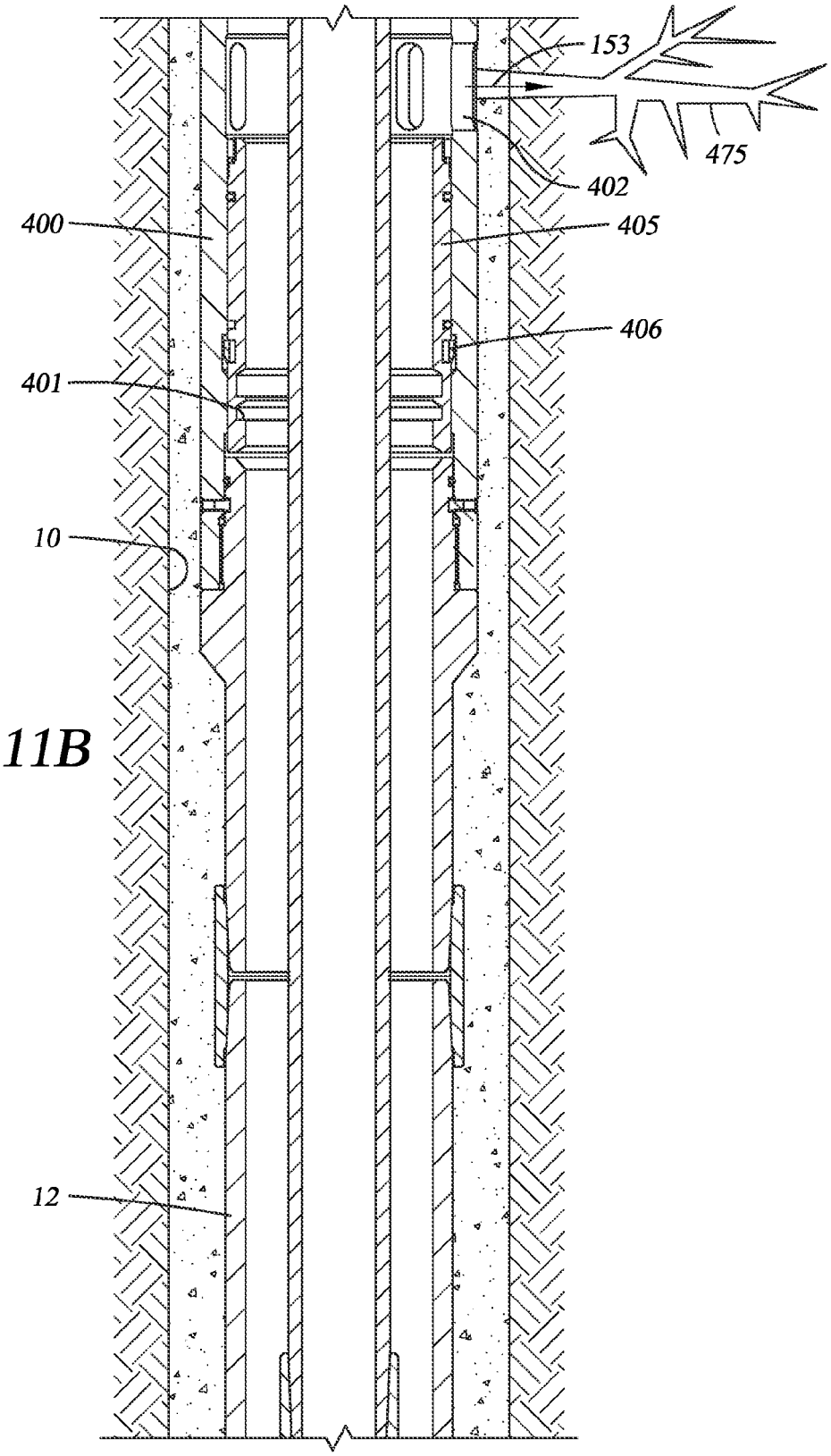

FIGS. 11A and 11B are a section view of the wellbore 10 with the keys 120 of the tool 100 located in the anchor sub 300 (FIG. 11A) and a fracturing job in progress (FIG. 11B) as illustrated by arrow 153. Inwardly facing profiles 301 in the anchor sub 300 are equipped with upwardly facing square shoulders that interact with the key profiles to prevent downward movement of the tool 100. In this position, high downward forces generated by the pumping of high pressure fracturing fluid will not move the tool downwards and the fracturing fluid will be forced through the ports 402 of the port sub 400 and into the formation 475 surrounding the wellbore 10.

Once a fracturing job is completed, the tool 100 can be moved upwards in the wellbore 10 (thereby telescoping and reopening the fluid path through the tool) and can be used with port and anchor subs at a higher location. Alternatively, the tool can be raised to the position of another drag block locating sub 200 and, landing the tool in the locator from above and moving downwards, the keys 120 can be again be recessed by covering them with the key sleeve 135. For example, considering FIGS. 6-8, it is clear that the keys 120, when initially recessed and covered with the key sleeve 135, can be exposed by causing the collet fingers 126 to move from their initial higher position to a lower profile by urging a central portion of the tool upwards. Similarly, if the tool is seated in the locator sub with the keys exposed, downwards movement of the tool will cause the collet fingers 126 to move from the lower to the higher profile, thereby re-covering the keys 120.

In addition to fracturing numerous areas of the wellbore through the use of the subs and the tool described, the tool can be tested in the wellbore by landing it in a test sub 600 (FIG. 1). The test sub is essentially an anchor sub that receives the keys 120 of the tool 100 and prohibits downward movement of the tool. Thereafter, a pressure check can be performed to ensure the integrity and functionality of the cup seals 140 as well as the operation of the keys 120 and retaining sleeve 125. The test sub is advantageously placed a relatively high location in the wellbore in case the tool has to be removed as a result of the test. In one embodiment, a locator sub 200, or the equivalent thereto is placed above and below the anchor sub 300. In this manner, the keys can be exposed (by the lower locator sub) for the test and then re-covered (by the upper locator sub) for the trip downhole.

In operation, the assembly is used in the following manner:

A casing string 12 is assembled at the surface of a well and run into the wellbore 10 to line a length of borehole. The string is assembled with groups of subs spaced apart as needed. The lower-most group preferably includes, at a lower end, a locator sub 200 for locating the drag blocks 110 of a fracturing tool 100, an anchor sub 300 disposed at a predetermined location above the locator sub 200 and usable to withstand downward force during a fracturing job, and a port sub 400 disposed a predetermined distance above the anchor sub to provide communication between an annulus around the tool and a formation therearound. After being located in the wellbore, the string 12 is cemented into place. In the operation described, a single group of three subs 200, 300, 400 is used. However, as explained herein, there could be any number of groups spaced along the string so that numerous locations along the length of the wellbore 10 can be fractured. Additionally, while the group is described as including a drag block locator sub 200, it will be understood that the locator sub may not be needed and likely not needed in groups higher up in the well, as the keys of the tool will have been uncovered after interaction with the first drag block locator sub 200 encountered.

With the string 12 cemented in the wellbore 10, a fracturing tool 100 is run in, preferably on a string of coiled tubing 101 to a location at or just below the drag block locator sub 200. The tool includes drag blocks 110, an exposable key assembly with outwardly biased keys 120, a telescopic feature to open a fluid path through the tool between lower 130 and upper 102 ports, and at least one sealing member 140 to facilitate the transportation of the tool 100 downhole with pressurized fluid. When the tool 100 reaches an interior of the locator sub 200, the outwardly-biased drag blocks 110 extend into a matching profile(s) 201 in the interior of the locator sub and while seated therein, provide resistance to upward movement of the tool 100. The resistance is adequate to permit the tool, when pulled upwards from the surface, to telescope and open the fluid path between ports 130, 102. Thereafter, the resistance remains adequate to cause a center portion of the tool 100, including the keys 120, to move upwards in relation to a key retaining sleeve 125. In this manner the outwardly-biased keys 120 are exposed and are ready to locate themselves in matching profiles in the upper subs 300, 400.

After upward force opens the fluid path and exposes the keys 120, continued upward force adequate to dislodge the drag blocks 110 from their mating profile(s) 201 in the locator sub 200 and the tool 100 is moved upwards in the wellbore 10 to the location of the anchor sub 300. Because the profiles 301 in the anchor sub are sloped in a downward-facing direction and because the profiles formed in the keys 120 are sloped in an upwards-facing direction, the tool 100 moves past the anchor sub 300 without interference as it moves upwards. The tool 100 is then raised past the location of the port sub 400 (the profiles 401 of the port sub 400, like those of the anchor sub 300 do not interfere with the keys 120 of the upwardly moving tool 100). At this point, in one embodiment, the tool 100 is pumped down with fluid using the cup seals to seal the annulus between the tool and the wellbore 10. The pumping action causes the telescoping feature to close the fluid path through the tool 100 and the tool is lowered until the profiles formed on the keys 120 interact with the profiles 401 formed in the port sub 400. Because of the downward facing, square shoulders formed on the keys 120 and upward facing, square shoulders making up the profiles 401 formed in the interior of the port sub, the tool 100 is temporality locked in place. Additional pumping/increased pressure causes the keys 120 to move a port sleeve 405 downwards to expose a plurality of ports 402 leading from the port sub to a formation 475 to be treated by fracturing. An additional profile formed adjacent the other profiles of the port sub is constructed and arranged to permit the keys 120 to become freed as the port sleeve reaches its completely open position. In this manner, the tool 100 can be pumped further down the wellbore after the ports 402 have been exposed.

In the next step, the tool 100 is pumped down until it locates the anchor sub 300. Like the port sub 400, the anchor sub has profiles 301 with upward facing square shoulders that mate with downward facing square shoulders of the keys 120, thereby preventing downward movement of the tool 100 past the sub 300 while the keys are exposed. In this position, fracturing fluid is introduced and pumped at high pressure through the open ports 402 and into a surrounding formation 475. The anchor sub 300 anchors the tool 100 and prevents it from moving downward, even in light of the high pressure fracturing fluid acting upon the cup seals 140.

After the fracturing job is completed, the tool 100 is pulled upward, again opening the fluid path due telescopic action and the cooperating profiles between the keys 120 and the anchor sub 300. The tool travels unhindered through the port sub 400 and, at a location above the group of components, if another locator sub 200 is located in the string, the tool can be pulled through the sub 200 without interference and continue up-hole to perform additional fracturing jobs with the keys 120 exposed. Or, if the tool is pushed downwards in the locator sub 200, the keys can be re-covered and the tool 100 can then move downhole to another set of components.

In addition to operating and fracturing through port subs 400 one-at-a-time, a fracturing job can be performed through a number of port subs simultaneously by initially opening each sleeve in a group to establish fluid communication between all the subs and their associated formations and then pumping fracturing or treatment fluid at sufficient pressure and volume to all of the port subs at once. In this arrangement, the casing string might be assembled with a plurality of port subs above a single anchor sub to permit a lower end of the wellbore to be isolated while permitting communication between each port sub thereabove. Examples of fracturing through multiple port subs at once are disclosed in U.S. publication Nos. 2013/0043042 A1 and 2013/0043043 A1 and those publications are incorporated herein by reference in their entirety.

In another embodiment, the tool is not run-in on a coiled tubing string. Rather, the tool is run on conductive cable that is capable of maintaining the weight of the tool and transmitting power as well as carrying signals between the surface of the well and the tool. In one embodiment, the cable and its signal and power capabilities are used to actuate the keys using, for instance, a solenoid-powered switch and piston member at the tool. With an automated way to expose and retract the keys, there is no need for a drag block locator sub and profiles related thereto. The location of the tool and its keys is determined in one instance by monitoring pumping pressures and measuring the length of cable in the wellbore. Similarly, a fluid path through the tool can be opened due to an electronic signal from the surface prior to raising the tool and re-closed prior to lowering the tool in the wellbore and/or performing a fracturing job. In this manner pulling or pushing (pumping) the tool is not necessary to telescope the tool and open the fluid path. In every case, downward movement of the tool is preferably performed by pumping fluid against the cup seals. Conductive "slickline" cable is well known in the art and described in international application publication no. WO1999048111 A1 which is incorporated by reference herein in its entirety.

Figure 12A:
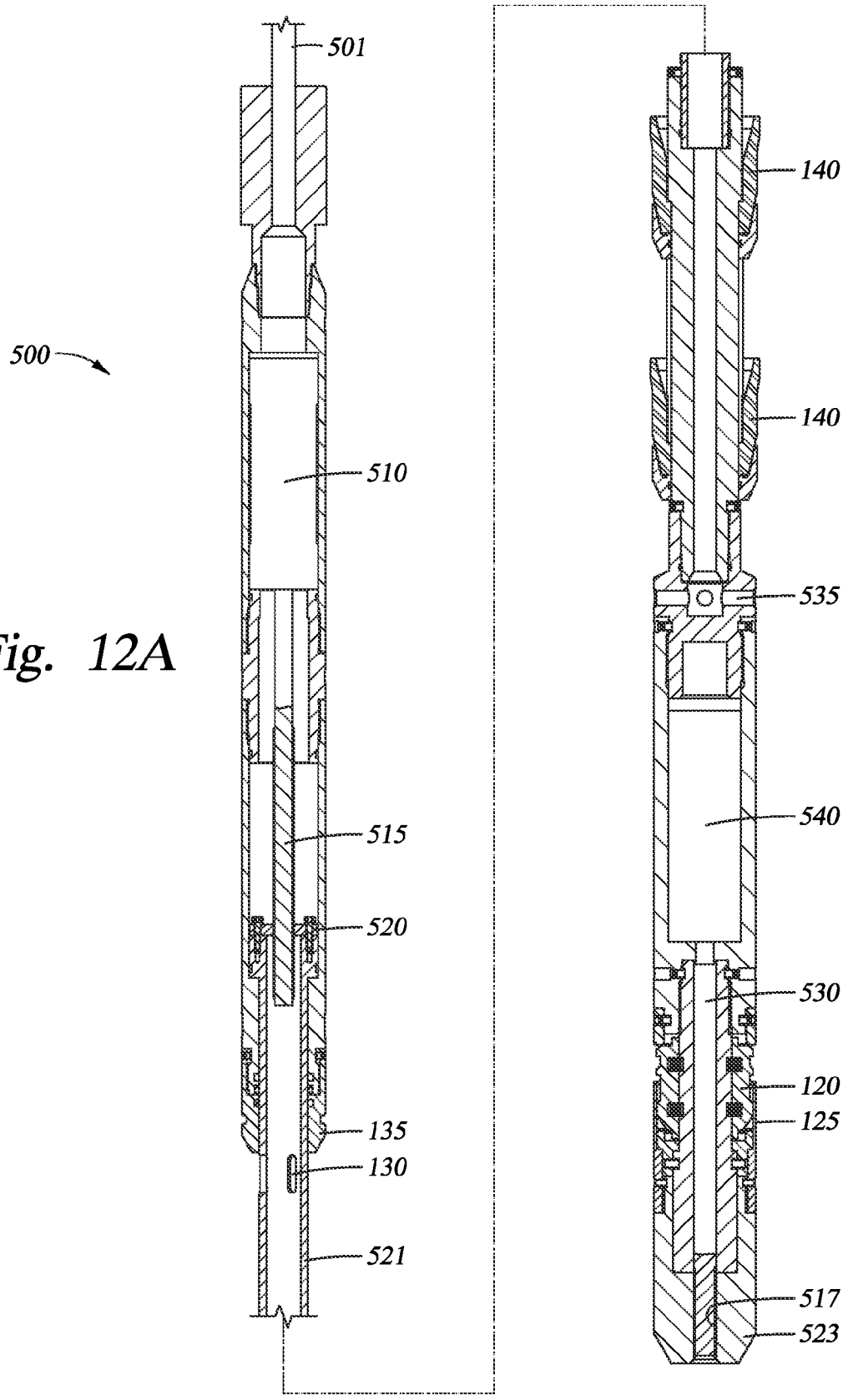
FIGS. 12A, B illustrate one embodiment where a tool is shifted between its various positions electrically.
Figure 12B:
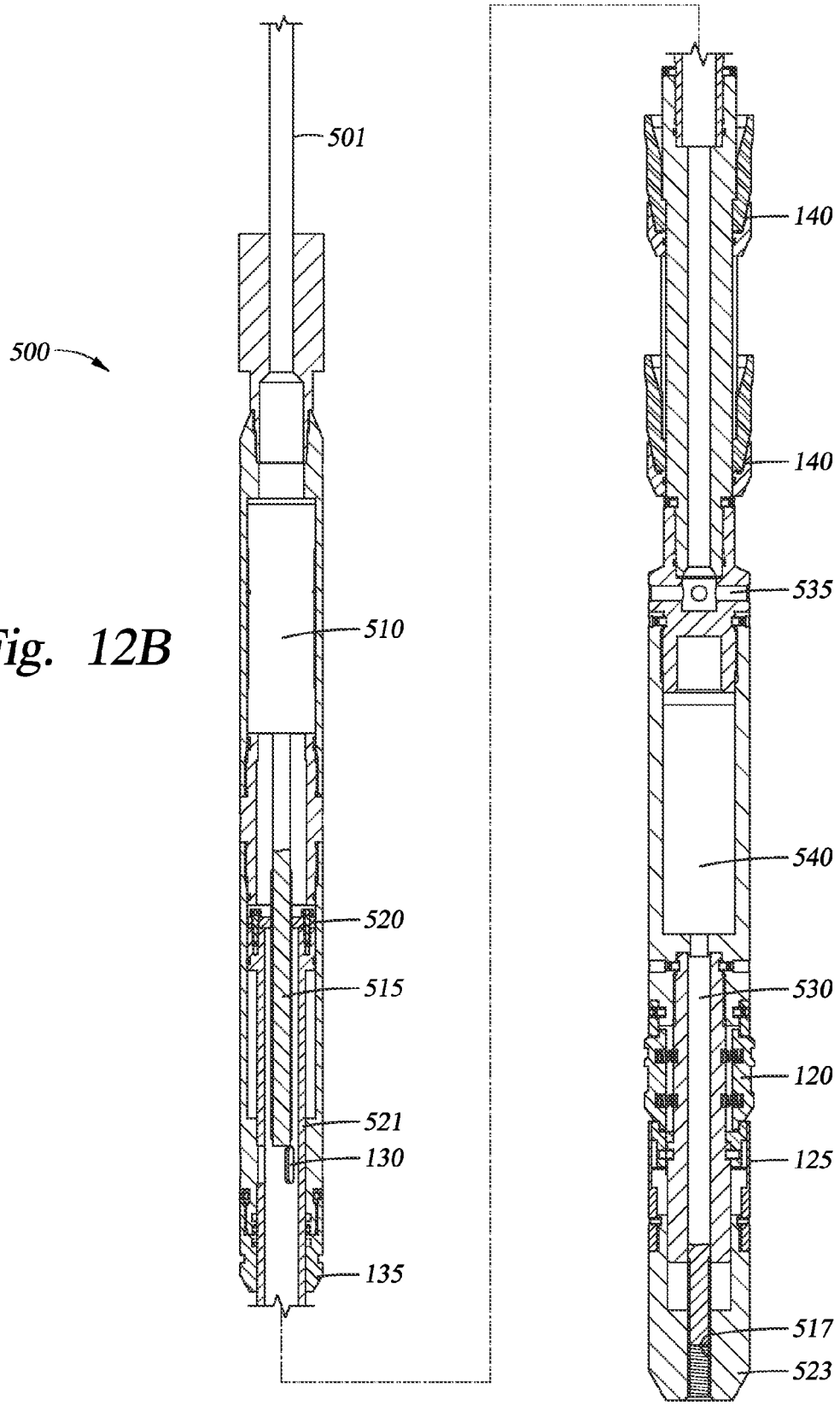

FIGS. 12A, B illustrate one embodiment where a tool 500 is shifted between its various positions electrically rather than by means previously disclosed. FIG. 12A is a section view of the tool 500 showing conductive cable 501, a transducer, in this case an electric motor 510 located at an upper end of the tool and a threaded shaft 515 extending downwards from the motor. The purpose of the threaded shaft 515 is to transmit motion to a lower part 521 of the tool 500 that includes ports 130. The ports, when exposed, permit fluid flow through an interior of the tool 500 in the area of the cup seals 140, rather than in an annulus between the tool 500 and the wellbore (not shown). In the Figure, the ports 130 are shown in an exposed position relative to a sleeve 135 as the threaded shaft 515, and mating threaded body portion 520 have moved the lower part 521 of the tool (that includes the ports 130) downwards. In FIG. 12B however, the motor 510 and shaft 515 have caused the lower part 521 to retract to a location whereby the ports 130 are covered by sleeve 135. For example, with the ports exposed as in FIG. 12A, fluid can flow into the ports 130, extend through the tool and flow out a set of lower ports 535, thereby avoiding the annulus in the area of the cup seals 140. By using the electrical arrangement shown, the ports 130 can be exposed or covered in an automated fashion without putting the conductive cable 501 in tension by pulling from the surface.

Also shown in FIGS. 12A, B is an electrical means of exposing the keys 120 of the tool 500. As with the earlier embodiments, the spring-biased keys 120 are initially covered by a sleeve 125 and then exposed when the sleeve is moved out of engagement with the keys. In the prior embodiments, the sleeve 125 is moved due to an upward force placed on the tool. In the embodiment of FIGS. 12A, B however, the sleeve 125 is moved away from the keys 120 due to a lower threaded shaft 530 extending from a lower motor 540. In FIG. 12A, sleeve 125 is in place over the keys 120 and in FIG. 12B the shaft 530 has transmitted a downward motion to the sleeve, moving the sleeve away and permitting the keys 120 to be exposed. As shown, motion is transmitted between the threaded shaft 530 and a similarly threaded bore 517 formed in a lower end 523 of the tool. In this manner, the keys can be exposed or re-covered at any time depending upon an operator's needs during a fracturing job.

In one example, the tool 500 illustrated in the embodiment of FIGS. 12A, B is operated as shown in FIG. 12A with the ports 130 uncovered and the keys 120 covered. In this configuration, the tool 500 can be lifted with fluid flowing freely through the tool (thereby avoiding the annulus in the area of the cup seals 140) and the covered keys will not interact with inwardly facing profiles. Conversely, the tool is placed in the configuration of FIG. 12B with the ports closed in order to move the tool downwards by pumping against the cup seals. The keys 120 are exposed whenever they are needed to interact with matching profiles of a sub.

Figure 13A:
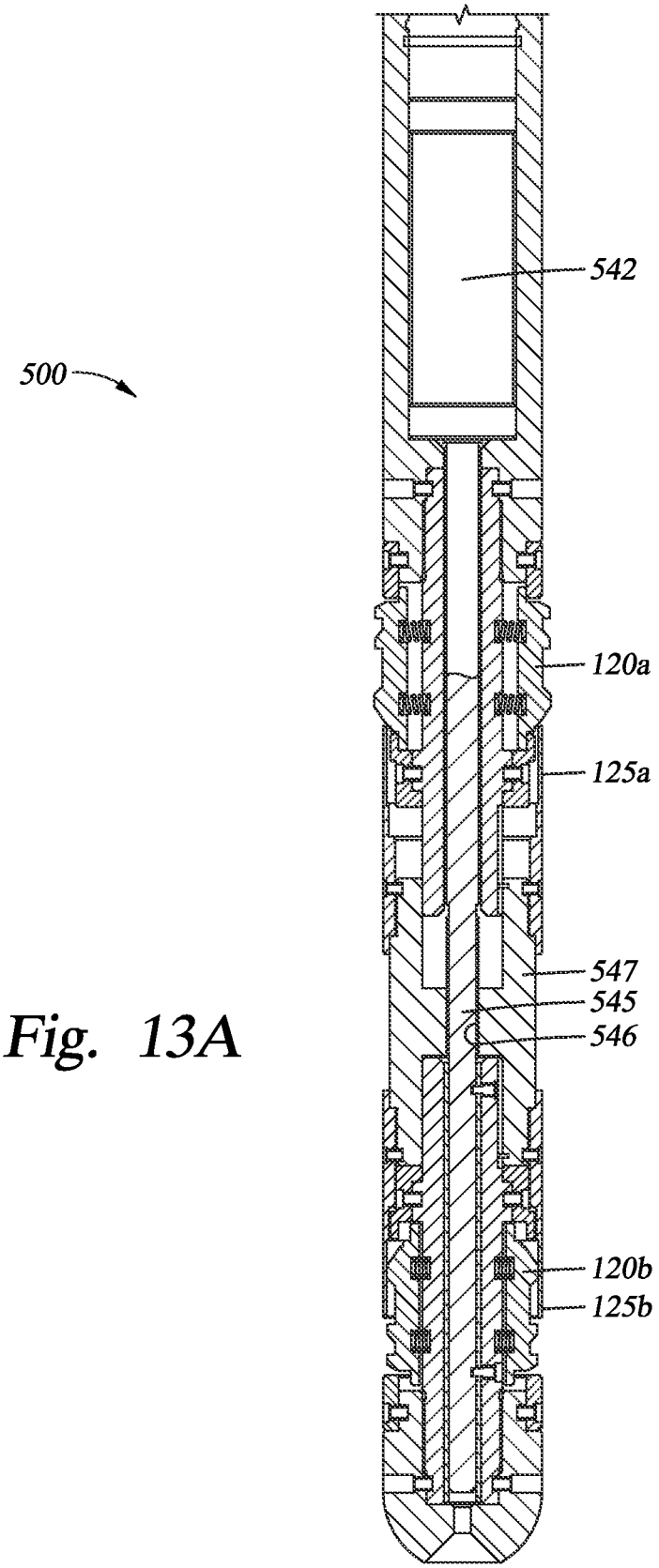
FIGS. 13A, B illustrate an electrical-type alternative embodiment wherein two sets of keys are provided.
Figure 13B:
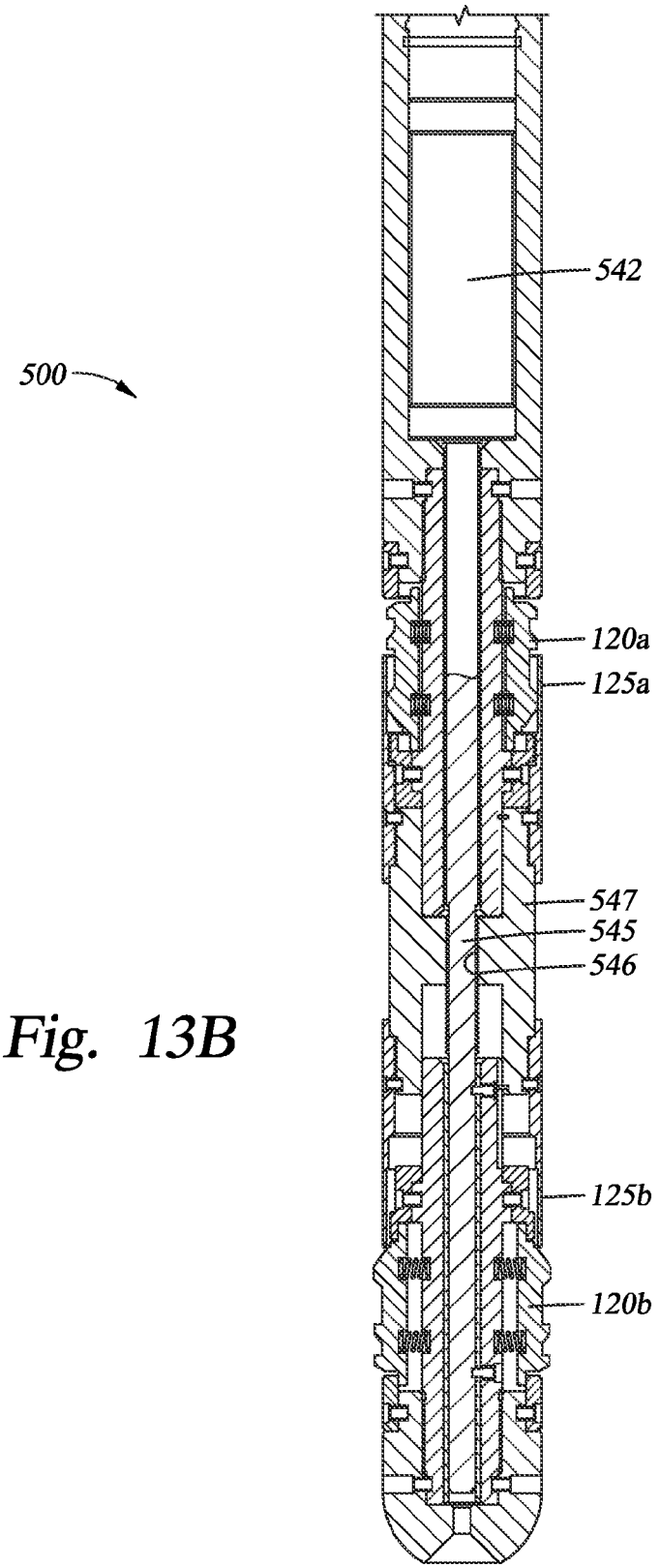
FIGS. 13C, D show a sub having two inwardly facing profiles.
Figure 13C:
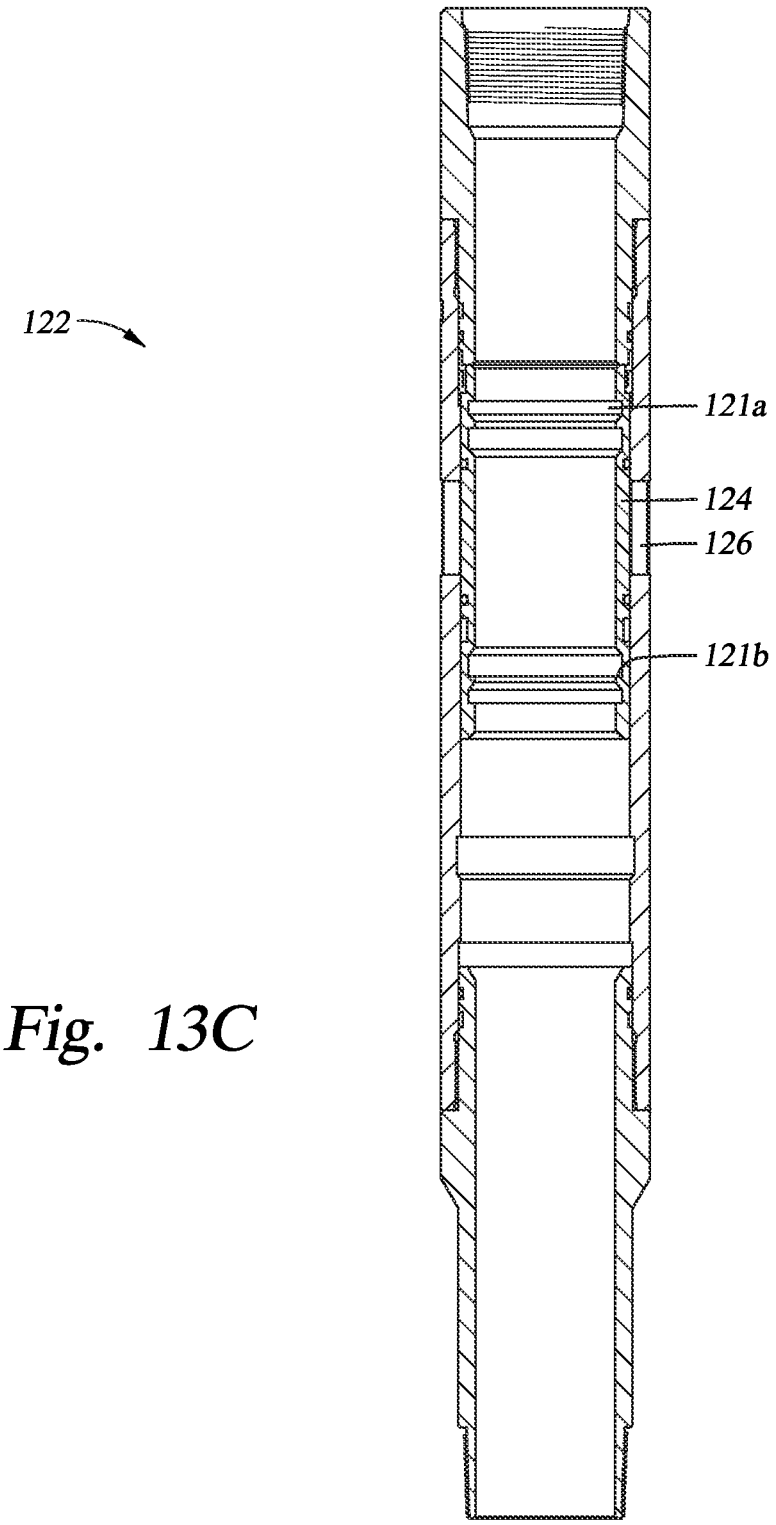

FIGS. 13A-C illustrate an electrical-type alternative embodiment of the tool 500 wherein two sets of keys 120*a*, 120*b* are provided, along with a single motor and shaft arranged to operate each set of keys in a manner whereby when one set is exposed, the other set is covered. Visible in the Figures is a single motor 542 and threaded shaft 545. Like other embodiments, the shaft 545 is threaded and rotatable by the motor 542. Rotation of the shaft 545 causes movement of an outer part 547 of the tool 500 that includes an area 546 of inwardly facing threads as well as two sleeves 125*a*, 125*b*, all of which move together as movement is transmitted by the rotating shaft 545. In FIG. 13A, the upper set of keys 120*a* is shown in an extended position with its sleeve 125*a* moved away and a lower set of keys 120*b* is covered by its own sleeve 125*b*. In FIG. 13B on the other hand, the outer part 547 has been moved upwards relative to the keys and exposed the lower set of keys 120*b* while covering the upper set 120*a*.

Figure 13D:
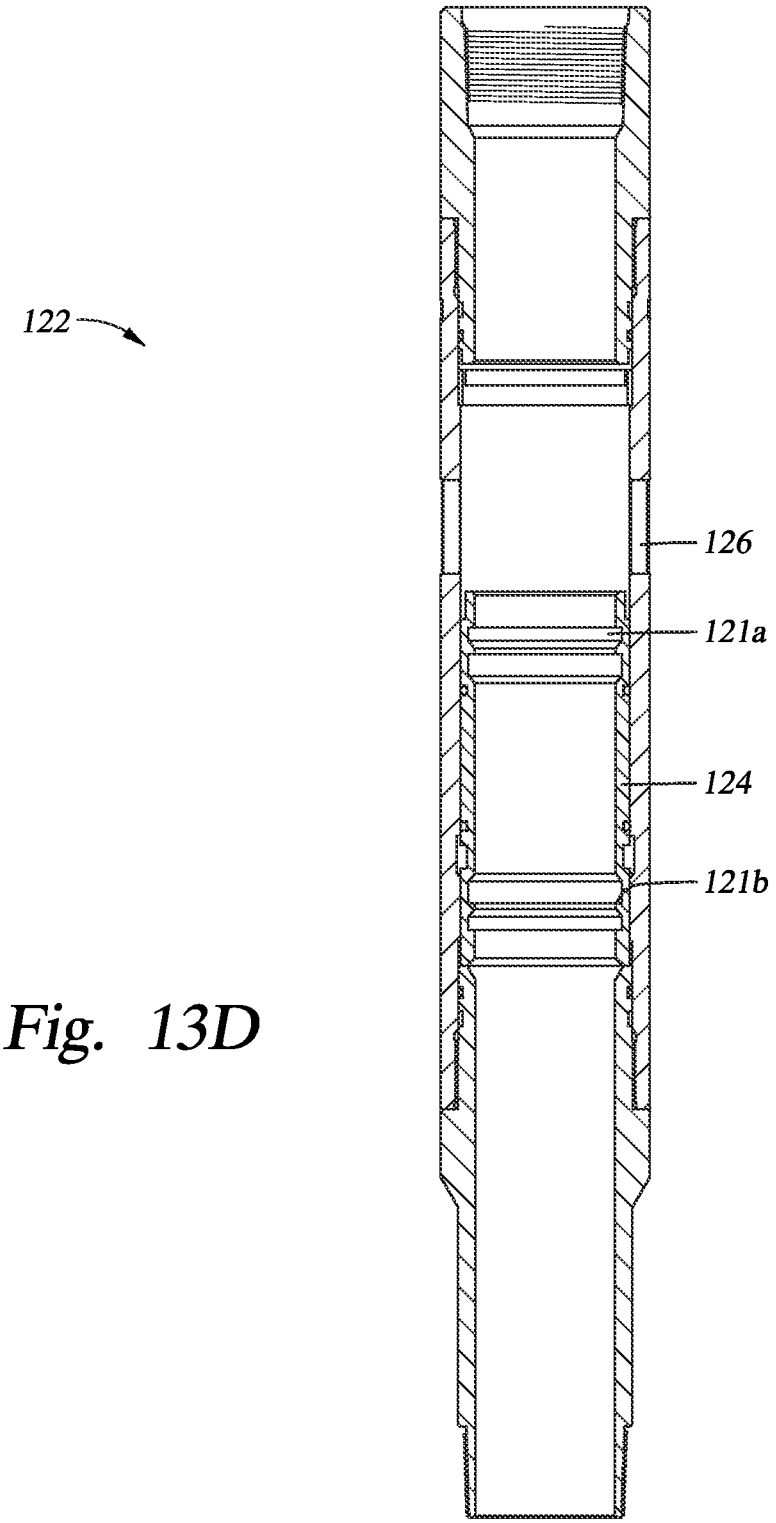

In the embodiment of FIGS. 13A, B the upper 120*a* and lower 120*b* keys have opposite or "mirrored" profiles whereby one set of keys 120*b* interacts with subs when the tool is moving upwards in a wellbore and the other set 120*a* interacts when the tool moves downwards. In previous embodiments, the single set of keys were similar to the upper keys 120*a* and were designed to operate only as the tool 500 moves downwards in the wellbore 10. In the present embodiment however, the tool can open a sleeve when moving in one direction and close the sleeve when moving in the other direction. FIGS. 13C, D show a sub 122 constructed and arranged to operate with the embodiment of the tool 500 shown in FIGS. 13A, B. The sub 122 has two inwardly facing profiles 121*a*, 121*b* and a sleeve 124 that can be opened and closed to expose ports 126. In a typical embodiment, ports 126 are used to provide a fluid path for fracturing fluid to be injected into an adjacent formation (not shown). In FIG. 13C the ports 126 are blocked by sleeve 124 and in FIG. 13D, the ports are open. The upper profile 121*a* operates with the lower set of keys 120*b* and the lower profile 121*b* operates with the upper set of keys 120*a*. The use of downhole electrical motors is well known in the art and in the embodiments shown could be DC or 3-phase AC motors. Additionally, the shafts could be non-threaded and operated by linear motors, whereby the shaft moves axially between positions rather than rotationally.

FIGS. 14 A-E illustrate an alternative embodiment relying on wireless identification tags, such as radio frequency identification (RFID) tags to operate a tool in a wellbore. In one instance the tags are "passive" tags and an electronics package is provided downhole and includes one or more antennas, a memory unit, a transmitter, and a radio frequency (RF) power generator for operating the transmitter. In practice, the tags are introduced into the wellbore from the surface, energized via the antenna, and provide information back to the antenna that becomes a command. In the present case, the command can cause a downhole transducer in the form of a motor, with its own battery, to operate a movable member within the tool. The tags may be introduced with a launcher or simply dropped into the well manually. Typically, multiple tags are dropped to ensure communication between at least one of the tags and the antenna.

Figure 14A:
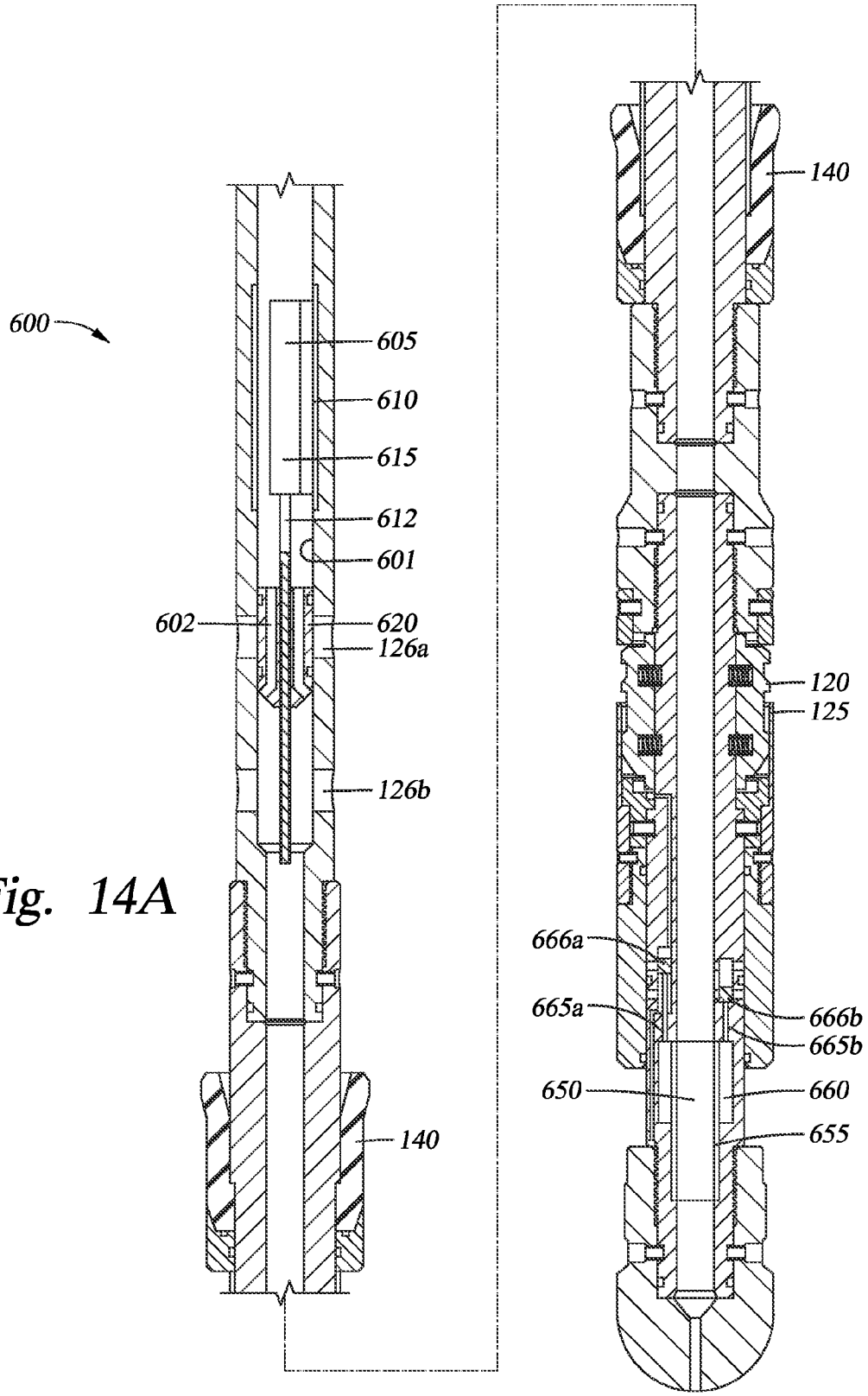
FIGS. 14 A-E illustrate an alternative embodiment relying on wireless identification tags, such as radio frequency identification (RFID) tags to operate a tool in the wellbore.
Figure 14C:
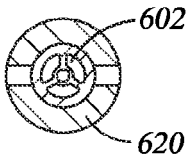
Figure 14C:
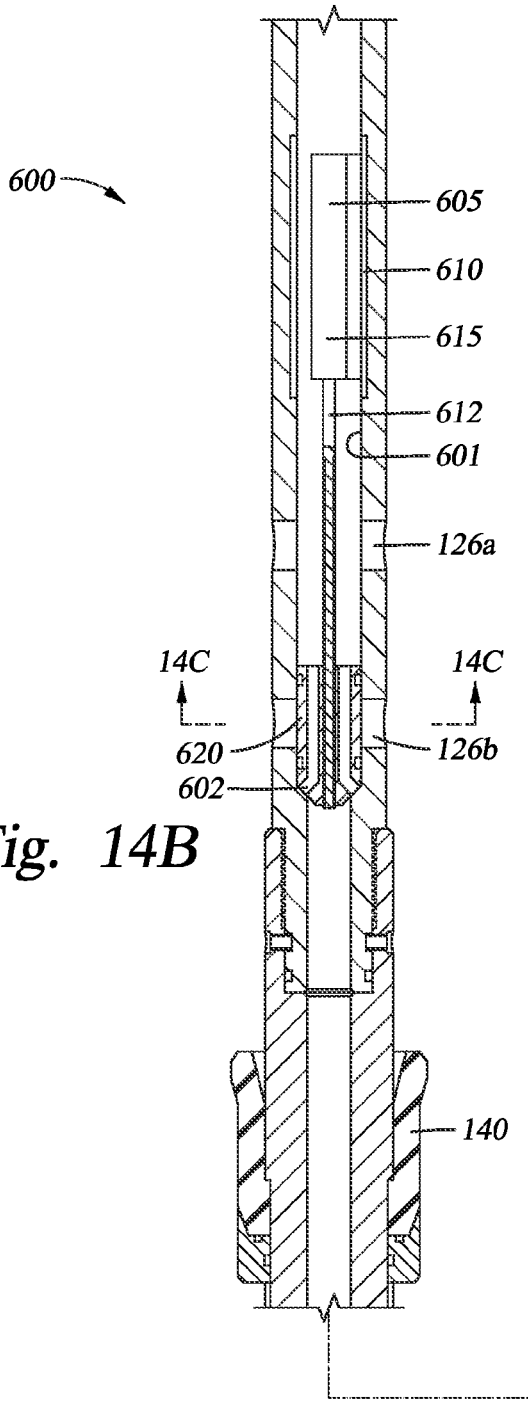
Figure 14B:
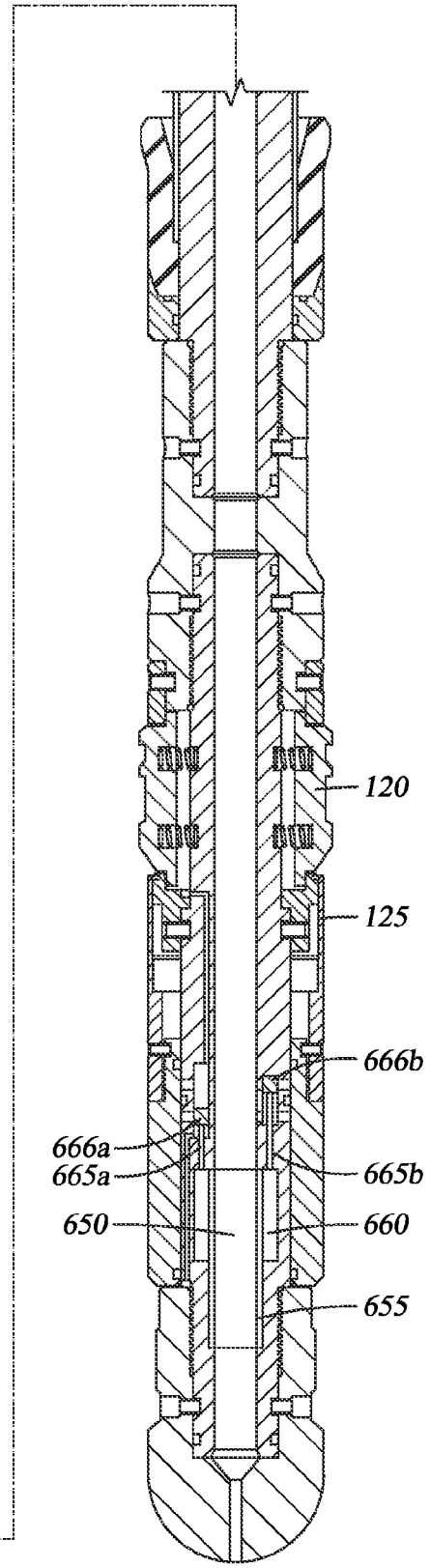

FIG. 14A is a section view of a tool 600 that would typically be run into the wellbore on coiled tubing (not shown). Like other embodiments of the invention, tool 600 includes cup seals 140 to seal an annular area between the tool 600 and a wellbore (not shown) during a fracturing operation. Also, like other embodiments, there is a selective means for permitting fluid to flow through the tool, thereby avoiding the annulus in the area of the cup seals 140. The tool 600 also includes retractable keys 120. Considering the tool of FIG. 14A in detail, an electronics package 605 in the tool includes an antenna 610 that is disposed adjacent an inside diameter of the central bore 601 of the tool. A battery powered motor 615 is disposed adjacent the antenna 610. The motor includes a threaded shaft 612 that is rotatable to transmit motion to a plug member 620 that is disposed along the threaded shaft. The plug member 620 is movable to block an upper 126*a* or lower 126*b* set of ports leading from an exterior to an interior of the tool 600. When the upper ports 126*a* are blocked as shown in FIG. 14A, fluid flow from the annulus can enter the tool via the lower ports 126*b* and exit another set of ports located below the cup seals 140. In this manner, fluid flow through the tool is permitted in the area of the cup seals 140. Conversely, when the plug is blocking the lower ports 126*b* (FIG. 14B), fluid from the annulus is prevented from passing though the tool in a downward direction. In addition to blocking ports, the plug 620 also includes a flow path 602 from an upper to a lower end that permits the passage of some fluid and other objects (like RFID tags) through the bore 601 of the tool 600. The flow path 602 is shown in FIG. 14C.

Figure 14D:
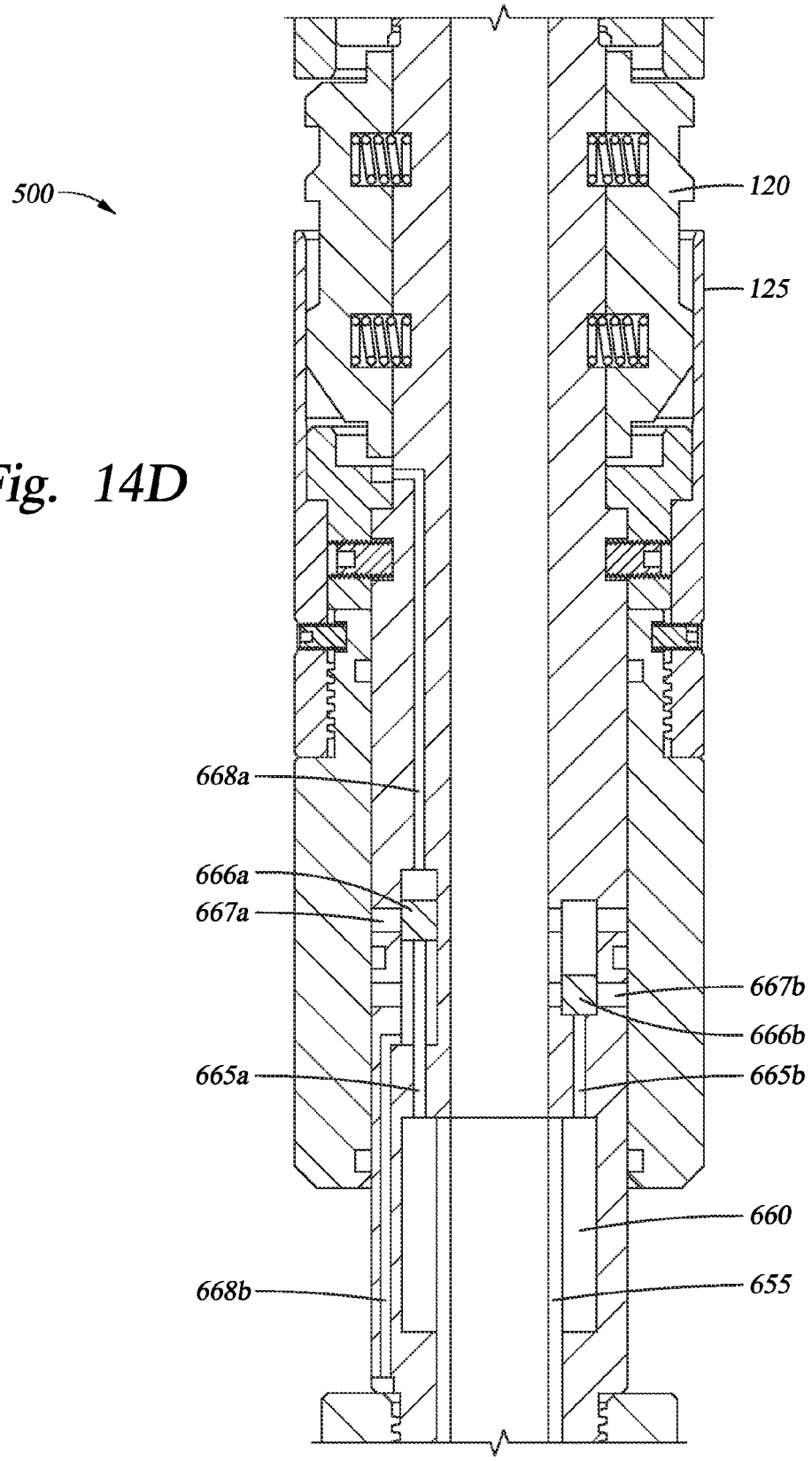
Figure 14E:
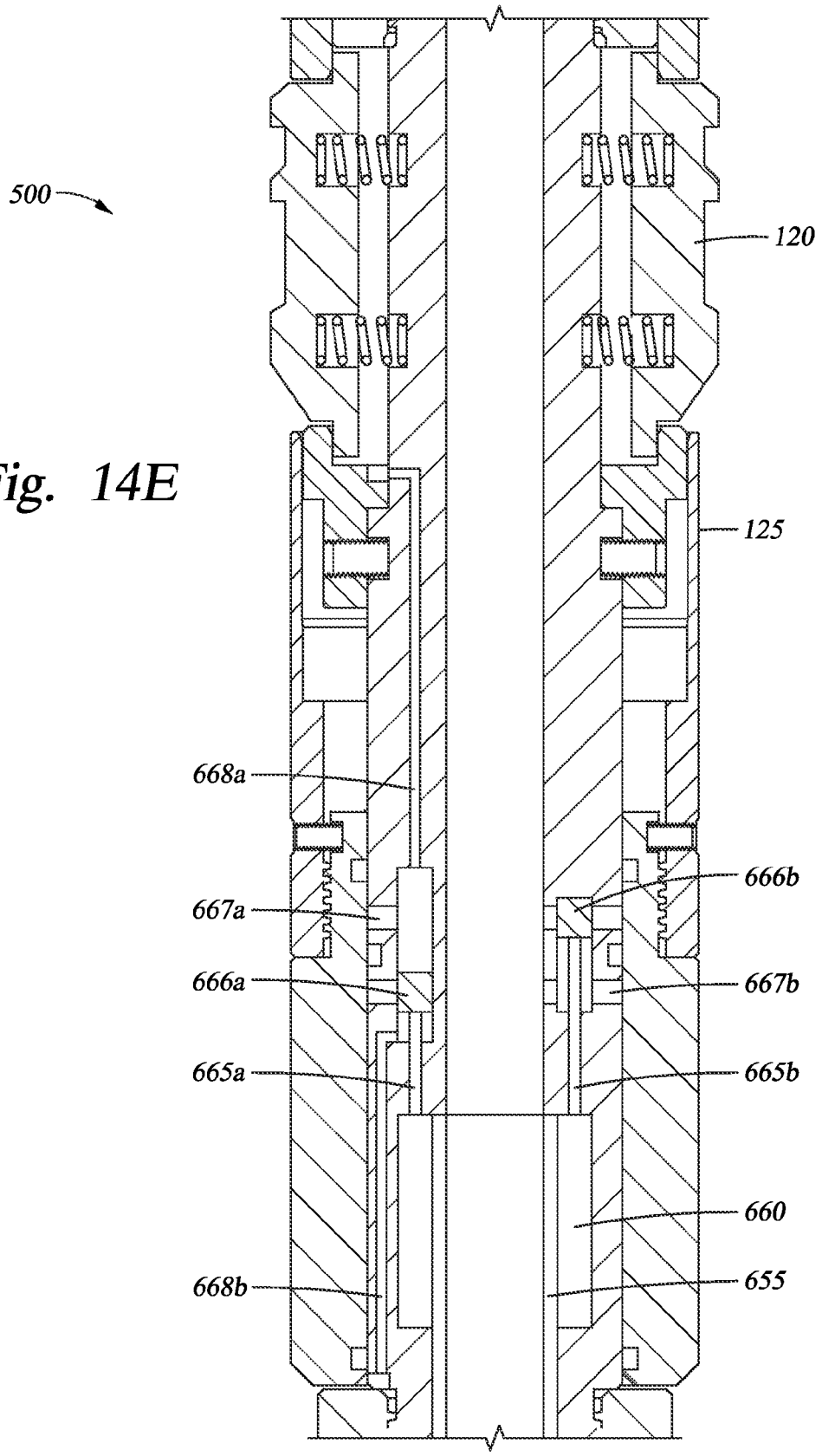

At a lower end of the tool is another electronics package 650 including an antenna 655, and a battery powered motor 660 (or alternatively, two motors). The purpose of the lower package 650 is to move a retaining sleeve 125 in order to cover and uncover the keys 120. FIGS. 14D, E illustrate the lower package and its operation in greater detail. The motor 660 includes two relatively small, extendable and retractable shafts 665*a, b* with a plug 666*a, b* at the end of each. The shafts move in opposite directions in order to cause one plug to cover a first lower port 667*b* while the other plug covers a first upper port 667*a*. The purpose of the shafts and plugs is to manipulate sleeve 125 in order to retract (FIG. 14D) or expose (FIG. 14E) the keys 120. At any one time, one of the shaft/plug provides access to a piston surface and the other provides access to a venting channel. The upper port 667*b* leads to an annular area between the sleeve 125 and the tool body and the lower port 667*a* leads to a lower annular area between the same two parts. Each annular area is equipped with a venting path 668*a*, 668*b* to expel fluid as the other area is filled.

In operation, the tool of FIGS. 14A-E can operate and be used in a variety of ways. In one example, the tool 600 is run into a well on coil tubing with the components in the position shown in FIG. 14A (the flow through feature (ports 126*b*) open and the keys 120 in a retracted position. A fluid path through the tool in the area of the cup seals 140 permits through flow as the tool 600 is moved in the wellbore without interference of the seals 140 that essentially seal the annulus between the tool and a wellbore (not shown). At a lower end of the tool, the shafts 665*a*, 665*b* and plugs 666*a*, 666*b* are in a position whereby sleeve 125 is covering the spring biased keys 120, causing them to remain retracted. At some time in a fracturing operation, the keys will be exposed in order to utilize their outwardly facing profiles to mate with matching inwardly facing profiles on subs in an outer string of tubulars in the wellbore, typically moving a sleeve to access fracturing ports or acting to anchor the tool in the wellbore during a fracturing job, for example.

The open/closed condition of the various ports of the tool is caused by RFID tags introduced from the surface of the well. In one example a tag or bunch of tags are dropped into the bore 601 of the tool to interact with the antenna 610 of the upper electronics package 605. The tags travel through the bore 601 of the tool or the tags are introduced through the annulus and a communication port leading from the upper antenna 610 to an outer wall of the tool interacts with one or more of the tags. In the simplest example, the tags are energized by the antenna 610 and then send a signal/command back to the antenna that operates the motor 615, thereby shifting the plug 620 in the tool 600 to a lower position where it blocks the lower ports 126*b*, thereby preventing fluid flow through the tool. Similarly, tags with a different pre-program are introduced into the wellbore to reach and interact with lower antenna 655. For example, the tags can reach the lower antenna either utilizing flow path 602 formed in plug 620 (FIG. 14C) or even via the annulus, following a path into the tool 600 through the lower ports 126*a*. In either case, the antenna 665 receives a command and the motor 660 with its two shafts 665*a, b* and plugs 666*a, b*, move sleeve 125 to uncover the keys 120. In a more complex example, the upper electronics package 605 can receive a single command to shift the plug 620 to the lower position at some future time and the lower package 650 can be commanded to immediately expose the keys 120. In this manner, the tool 600 can be moved in the wellbore due to the flow through position, while the extended keys are used to manipulate a port sub and are then located in an anchor sub. When the upper package 605 shifts the plug 620 to the closed position, fracturing can take place. In this manner, the tool 600 can be used any number of times to fracture different zones of a wellbore.

Figure 15A:
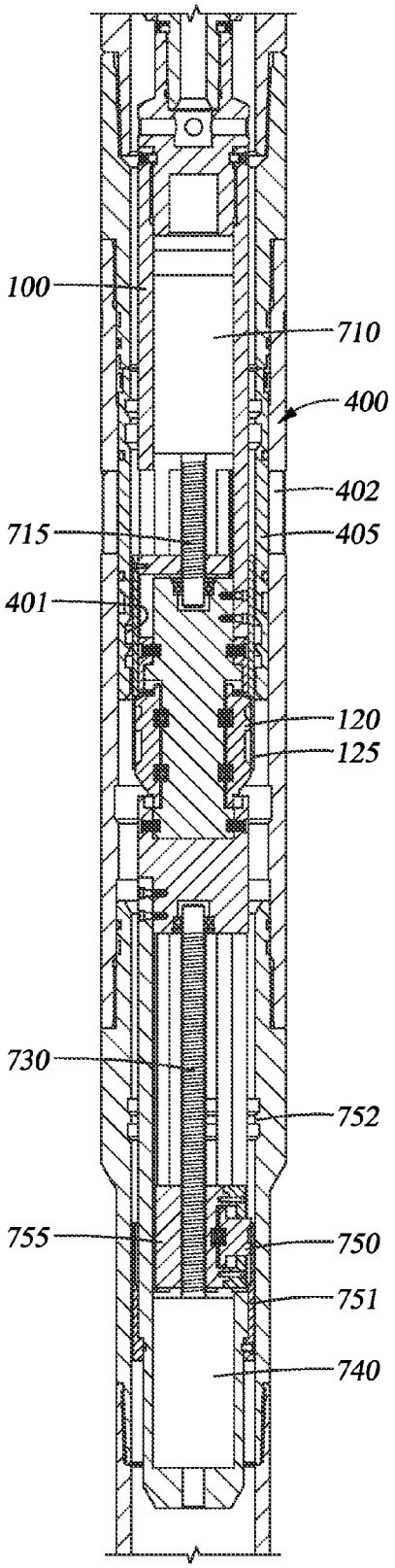
FIGS. 15 A-F illustrate an alternative embodiment permitting the ports of a port sub to be uncovered without pumping fluid against cup seals.
Figure 15B:
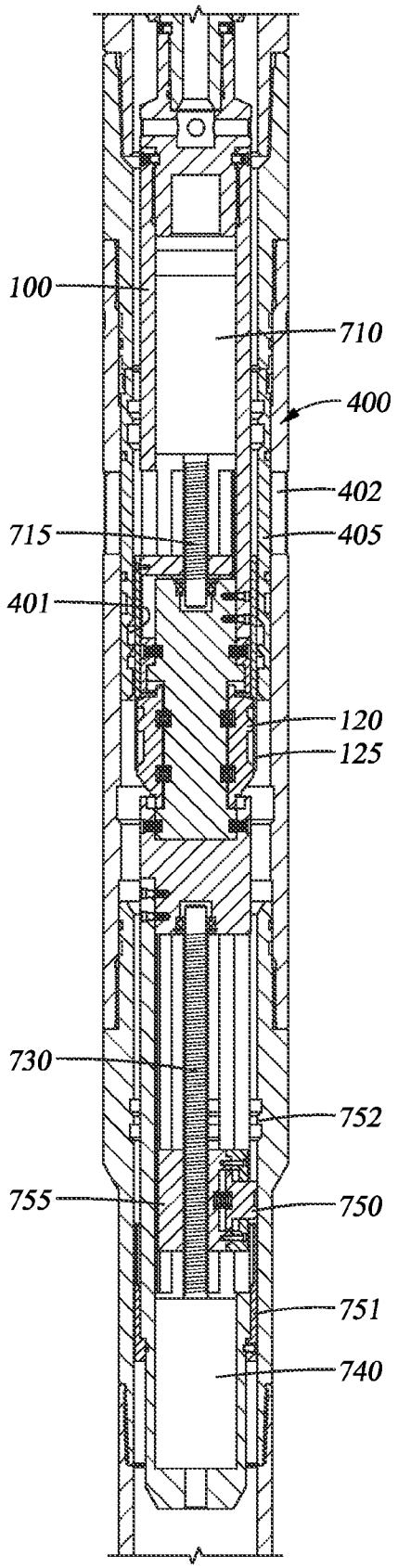
Figure 15C:
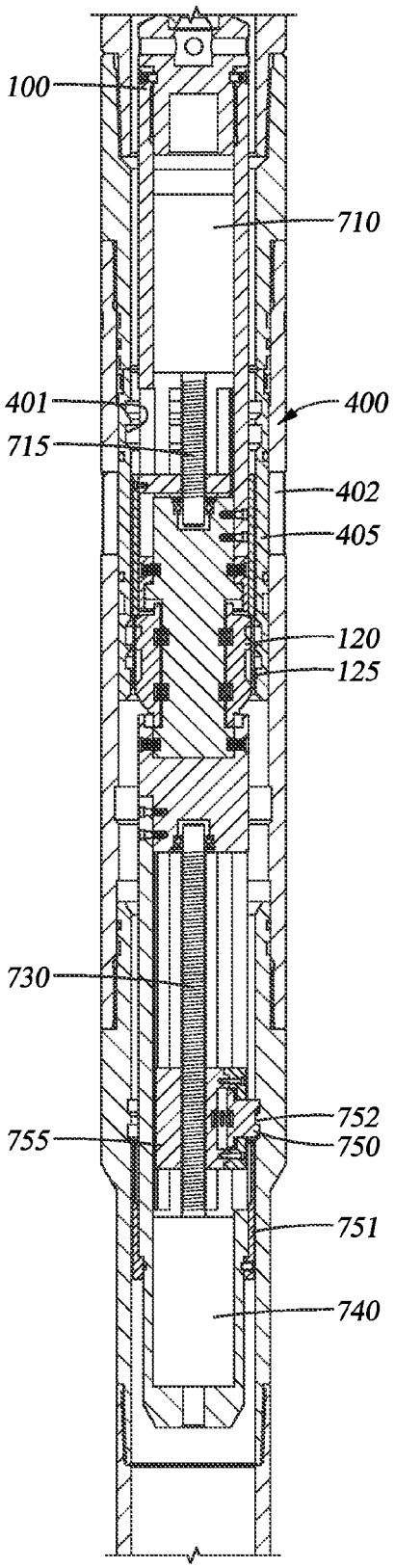
Figure 15D:
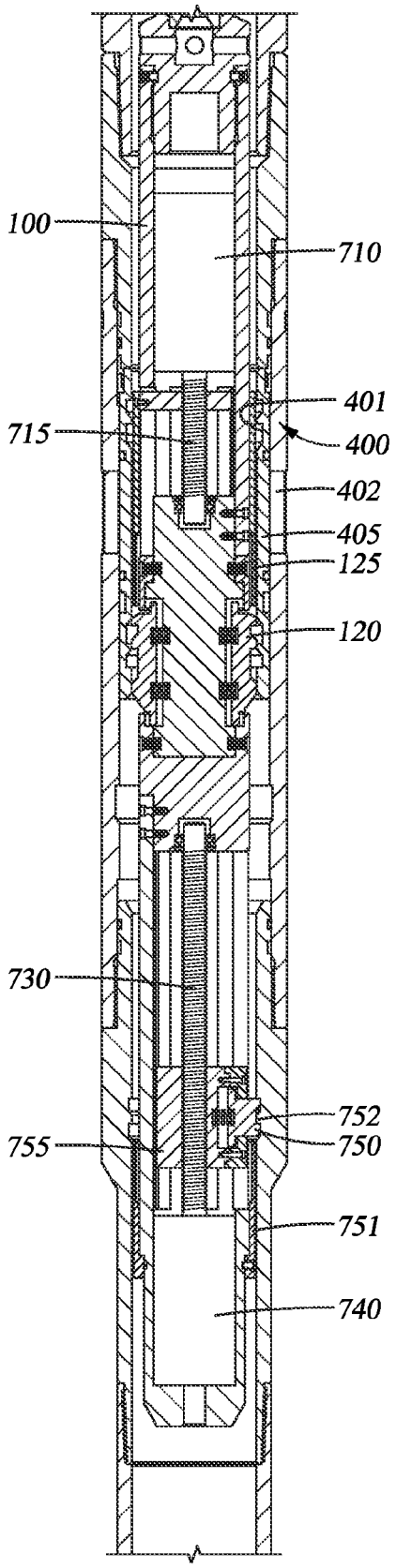
Figure 15E:
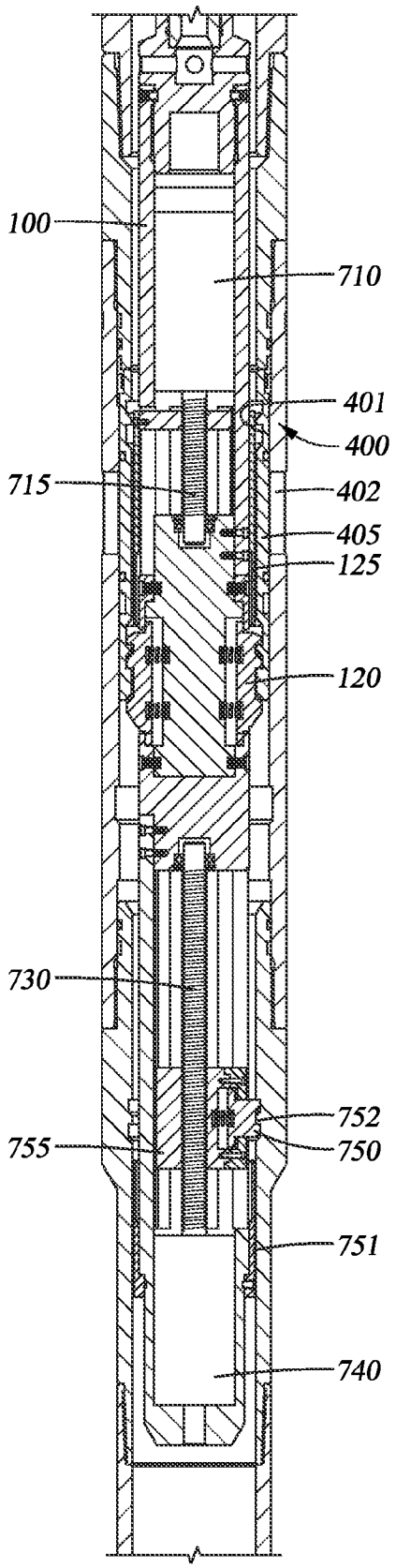
Figure 15F:
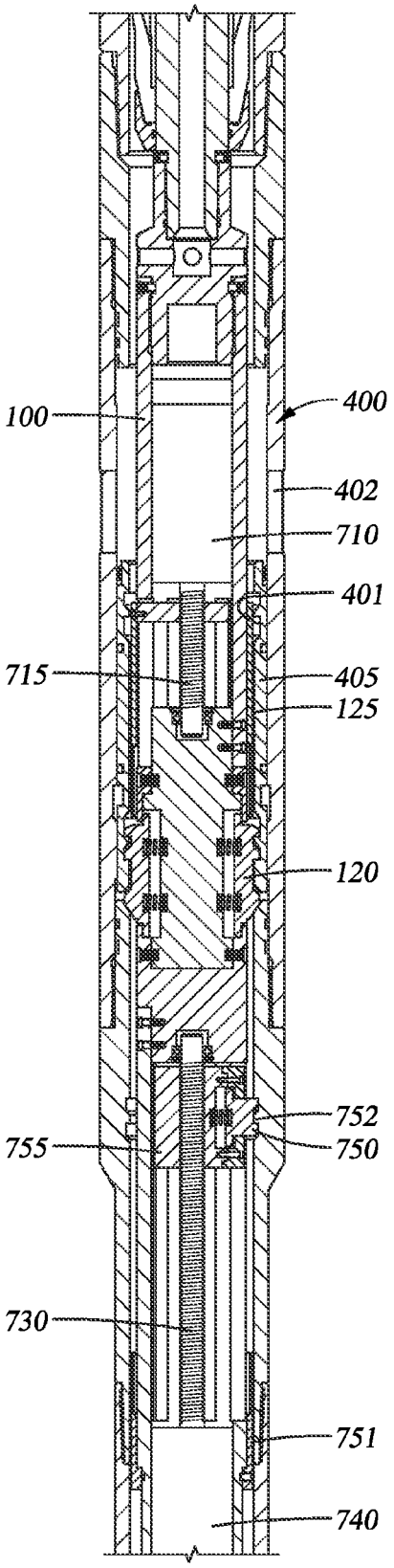

In an alternative embodiment shown in FIGS. 15A-F, a port sub 400 is opened and/or closed without manipulating a tool string or pumping fluid against cup seals. The arrangement is particularly useful when a number of different zones of interest are to be treated in a single trip into the well. FIG. 15A shows a portion of a tool 100 including an upper 710 and lower 740 motors as well as threaded shafts 715, 730 extending from each. The tool 100 is shown adjacent the port sub 400 as it would appear in a tubular string lining a wellbore. As with previous embodiments, keys 120 are initially covered by a sleeve 125 preventing their interaction with inwardly facing profiles 401 of the fracturing sub 400. A fracturing port 402 is covered by port sleeve 405. The lower threaded shaft 730 operates to axially move a spring-biased locating key assembly 755 that includes at least one spring-biased locating key 750 that is initially retained in a retracted position by a retaining sleeve 751. In the embodiment shown, the port sub 400 is equipped with at least one inwardly facing profile 752 constructed and arranged to be engaged by the locating key 750. In FIG. 15B, rotation of the lower threaded shaft 730 has caused the key assembly 755 and key 750 to move upwards relative to the remainder of the tool in the direction of the inwardly facing profile 752 and away from retaining sleeve 751. In FIG. 15C, the tool 100 has been pulled up slightly from the surface in order to finally land the key 750 in the profile 752. While the locating key 750 could be landed entirely by movement of the threaded shaft 730, in the embodiment shown the final landing is facilitated by raising the tool. In FIG. 15D, with the locating key 750 landed in the profile 752, upper motor 710 rotates the upper shaft 715 and raises a sleeve assembly 127 threaded thereto causing sleeve 125 to move upwards, thereby exposing keys 120. In FIG. 15E, with the keys 120 exposed, lower shaft 730 is again rotated just enough to land the keys in the profile 401. In FIG. 15F, additional rotation of the lower shaft moves port sleeve 405 downwards, thereby exposing ports 402 for a fracturing operation.

In one embodiment, the tool of embodiment 15A-F operates as follows: A cemented tubular string lines a wellbore and includes at least one fracturing sub 400 installed therein. The sub includes at least one port sleeve 405 having at least one inwardly facing profile 401 formed thereon and at least one inwardly facing locating profile 752 formed in the body of the sub 400. A tool 100 is run into the wellbore by any practical means and includes at least one extendable key 120 to interfere with the profile 401 of port sub 400 and at least one locating key 750 for interference with locating profile 752.

Initially, the tool 100 is lowered to a point ensuring the locating key 750 is below the profile 752. In the initial state, both keys 120 and 750 are temporarily retained in a retracted position by sleeves, 125, 751. Using lower motor 740, lower threaded shaft is rotated in order to raise key assembly 755 relative to the rest of the tool 100 thereby moving key 750 from under retaining sleeve 751 and towards inwardly facing locating profile 752. In one embodiment, the tool 100 is then raised from the surface to cause outwardly biased key 750 to interfere with and land in profile 752. With a portion of the tool body now axially fixed relative to the port sub 400, the upper motor is operated to raise sleeve 125 and expose outwardly biased keys 120. With the keys exposed and the tool still fixed relative to the sub 400, the lower motor is rotated to cause the keys 120 to interfere with and land in profiles 401. Additional operation of the lower motor moves port sleeve 405 downwards and away from ports 402, thereby providing fluid communication between an interior and exterior of the tool for fracturing or other treatment of an adjacent zone of interest. Depending on the needs of an operator, the forgoing method can be repeated a number of times with the same fracturing sub or with any number of subs disposed at various locations in the tubing string 12.

While the foregoing is directed to embodiments of the present invention, other and further embodiments of the invention may be devised without departing from the basic scope thereof, and the scope thereof is determined by the claims that follow.

The invention claimed is:

1. A method of treating a zone of interest in a wellbore, comprising:

providing a port sub, the port sub installed in a casing string lining the wellbore, the port sub having at least one port openable downhole, the port openable to provide a fluid path from an interior to an exterior of the port sub;

providing a tool, the tool insertable into the wellbore to a location adjacent the port sub, the tool usable to open the at least one port, the tool including:

at least one key formed on an outer surface of the tool, the key outwardly extending and usable to open the at least one port when the tool is in an operable mode and the key recessed when the tool is in a non-operable mode;

a first downhole transducer for opening and closing a fluid path between an upper and lower ends of the tool, the path extending longitudinally from a first to a second point within a body of the tool and bypassing at least one annular seal member disposed on an outer surface of the tool, the seal member movable with the tool in the wellbore; and a second downhole transducer for shifting the tool between the operable and non-operable modes; whereby the transducers each include an antenna associated therewith for receiving signals, each antenna providing commands to the transducer associated therewith; inserting the tool into the wellbore; communicating wirelessly with the first downhole transducer to open the fluid path; communicating wirelessly with the second downhole transducer to shift the tool from the non-operable mode to the operable mode; positioning the tool adjacent the port sub; closing the fluid path; and using the tool to open the at least one port.

2. The method of claim 1, wherein wireless communication with the transducers is via radio frequency identification (RFID) tags.

3. The method of claim 2, wherein the transducers are battery operable motors.

4. The method of claim 3, wherein the first transducer includes a shaft, the shaft in threaded communication with a plug wherein rotation of the shaft moves the plug between a first position in which the fluid path is open and a second position, in which the fluid path is substantially closed.

5. The method of claim 4, wherein in the first position the plug is adjacent an upper flow port and in a second position, the plug is adjacent a lower flow port.

6. The method of claim 5, wherein the second transducer includes two piston and shaft assemblies, the assemblies constructed and arranged whereby when a first piston and shaft is in an extended position, the second piston and shaft is in a retracted position.

7. The method of claim 6, wherein, when the first piston and shaft assembly is in an extended position, the tool is in the non-operable mode and when the second piston and shaft assembly is in an extended position, the tool is in the operable mode.

8. The method of claim 7, wherein the piston and shaft assemblies operate to move a sleeve relative to at least one spring-biased key, the key retracted in the non-operable mode and extended in the operable mode.

9. The method of claim 5, wherein the plug includes a fluid path between an upper and lower ends thereof.

10. The method of claim 1, further including pumping material through the port and into a surrounding formation to treat the zone of interest.

11. An apparatus for treating a zone of interest in a wellbore, comprising:

a tool, the tool insertable into the wellbore to a location adjacent a port sub and usable to open at least one port sleeve in the port sub, the tool including:

at least one key formed on an outer surface of the tool, the key outwardly extending and usable to open the at least one port sleeve when the tool is in an operable mode and the key recessed when the tool is in a non-operable mode;

a first downhole transducer for opening and closing a fluid path between a first and second axial locations along the tool, the path extending axially within a body of the tool between a first and second longitudinal location and bypassing at least one annular seal member disposed on an outer surface of the tool, the seal member movable with the tool in the wellbore; and a second downhole transducer for shifting the tool between the operable and non-operable modes;

whereby the transducers each include an antenna associated therewith for receiving signals via radio frequency identification (RFID), each antenna providing commands to the transducer associated therewith.

12. The apparatus of claim 11, wherein a first command to the first transducer causes a threaded shaft to be rotated, thereby transmitting motion to a plug member, the plug member opening or closing the fluid path between the first and second locations.

13. The apparatus of claim 11, wherein a second command to the second traducer moves the tool between the operable and inoperable modes.

14. The apparatus of claim 13, wherein in the inoperable mode, the at least one key is recessed due to a retaining sleeve.

15. A method of treating a zone of interest in a wellbore, comprising:

providing a port sub, the port sub installed in a casing string lining the wellbore, the port sub having at least one port openable downhole, the port openable to provide a fluid path from an interior to an exterior of the port sub;

providing a tool, the tool insertable into the wellbore to a location adjacent the port sub, the tool usable to open the at least one port, the tool including:

at least one key formed on an outer surface of the tool, the key outwardly extending and usable to open the at least one port when the tool is in an operable mode and the key recessed when the tool is in a non-operable mode;

a first downhole transducer for opening and closing a fluid path between an upper and lower ends of the tool; and a second downhole transducer for shifting the tool between the operable and non-operable modes;

whereby the transducers each include an antenna associated therewith for receiving signals, each antenna providing commands to the transducer associated therewith;

inserting the tool into the wellbore;

communicating wirelessly with the first downhole transducer to open the fluid path;

communicating wirelessly with the second downhole transducer to shift the tool from the non-operable mode to the operable mode;

positioning the tool adjacent the port sub;

closing the fluid path;

using the tool to open the at least one port;

wherein the second transducer includes two piston and shaft assemblies, the assemblies constructed and arranged whereby when a first piston and shaft is in an extended position, the second piston and shaft is in a retracted position; and wherein, when the first piston and shaft assembly is in an extended position, the tool is in the non-operable mode and when the second piston and shaft assembly is in an extended position, the tool is in the operable mode.

16. A method of treating a zone of interest in a wellbore, comprising:

providing a port sub, the port sub installed in a casing string lining the wellbore, the port sub having at least one port openable downhole, the port openable to provide a fluid path from an interior to an exterior of the port sub;

providing a tool, the tool insertable into the wellbore to a location adjacent the port sub, the tool usable to open the at least one port, the tool including:

at least one key formed on an outer surface of the tool, the key outwardly extending and usable to open the at least one port when the tool is in an operable mode and the key recessed when the tool is in a non-operable mode;

a first downhole transducer for opening and closing a fluid path between an upper and lower ends of the tool; and a second downhole transducer for shifting the tool between the operable and non-operable modes;

whereby the transducers each include an antenna associated therewith for receiving signals, each antenna providing commands to the transducer associated therewith;

inserting the tool into the wellbore;

communicating wirelessly with the first downhole transducer to open the fluid path;

communicating wirelessly with the second downhole transducer to shift the tool from the non-operable mode to the operable mode;

positioning the tool adjacent the port sub;

closing the fluid path; and using the tool to open the at least one port;

wherein wireless communication with the transducers is via radio frequency identification (RFID) tags;

wherein the transducers are battery operable motors;

wherein the first transducer includes a shaft, the shaft in threaded communication with a plug wherein rotation of the shaft moves the plug between a first position in which the fluid path is open and a second position, in which the fluid path is substantially closed;

wherein in the first position the plug is adjacent an upper flow port and in a second position, the plug is adjacent a lower flow port; and wherein the second transducer includes two piston and shaft assemblies, the assemblies constructed and arranged whereby when a first piston and shaft is in an extended position, the second piston and shaft is in a retracted position.

* * * * *